US007970305B2

(12) United States Patent
Okuno et al.

(10) Patent No.: US 7,970,305 B2
(45) Date of Patent: Jun. 28, 2011

(54) DEVELOPMENT APPARATUS, IMAGE FORMING APPARATUS AND IMAGE FORMING METHOD FOR CONSUMING DEGRADED TONER

(75) Inventors: Yuusuke Okuno, Toyokawa (JP); Tomohiro Kato, Okazaki (JP); Tomo Kitada, Toyokawa (JP); Toru Hayase, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 483 days.

(21) Appl. No.: 12/098,009

(22) Filed: Apr. 4, 2008

(65) Prior Publication Data

US 2009/0010666 A1 Jan. 8, 2009

(30) Foreign Application Priority Data

Jul. 5, 2007 (JP) ..... 2007-177542

(51) Int. Cl.
*G03G 15/06* (2006.01)
*G03G 15/08* (2006.01)

(52) U.S. Cl. ..... 399/55; 399/27

(58) Field of Classification Search ..... None
See application file for complete search history.

(56) References Cited

U.S. PATENT DOCUMENTS

| | | | | |
|---|---|---|---|---|
| 7,068,967 | B2 * | 6/2006 | Nakagawa | 399/232 |
| 2005/0047832 | A1 * | 3/2005 | Hashimoto | 399/284 |
| 2008/0152366 | A1 * | 6/2008 | Endou et al. | 399/27 |

FOREIGN PATENT DOCUMENTS

| | | | |
|---|---|---|---|
| JP | 06-295123 | | 10/1994 |
| JP | 9-160375 | A | 6/1997 |
| JP | 2000-206770 | A | 7/2000 |
| JP | 2000-330364 | | 11/2000 |
| JP | 2004-170651 | A | 6/2004 |
| JP | 2005-055842 | | 3/2005 |

OTHER PUBLICATIONS

Notification of Reasons for Rejection issued in corresponding Japanese Patent Application No. 2007-177542, mailed Feb. 23, 2010, and English translation thereof.

Notification of Reasons for Rejection, Japanese Application No. 2007-177542, dated Jun. 23, 2009.

* cited by examiner

*Primary Examiner* — David P Porta
*Assistant Examiner* — Carolyn Igyarto
(74) *Attorney, Agent, or Firm* — Buchanan Ingersoll & Rooney PC

(57) ABSTRACT

The development apparatus that develops an electrostatic latent image formed on an image carrier comprises: a developer roller operable to carry toner on a circumferential surface thereof and develop the electrostatic latent image using the toner; a supply roller operable to perform toner supply to the developer roller; a voltage applier operable to apply a bias voltage V1 to the developer roller and apply a bias voltage V2 to the supply roller; and a controller operable to control the voltage applier in a toner compulsive consumption mode so that a value obtained by subtracting an average S2 of the bias voltage V2 per unit time from an average S1 of the bias voltage V1 per unit time indicates the same polarity as a normal charging polarity of the toner. Here, the toner compulsive consumption mode performs development to compulsively consume the toner carried on the circumferential surface of the developer roller.

20 Claims, 12 Drawing Sheets

<IMAGE FORMATION MODE>

DEVELOPING BIAS
VOLTAGE (V)
T
T1
W1
480
0
-320
-920
TIME(ms)
VB1

SUPPLY BIAS
VOLTAGE (V)
T
T1
W2
480
0
-320
-1120
TIME(ms)
VB2

VOLTAGE (V)
480
0
-320
-920
-1120
TIME(ms)
200V
DEVELOPING BIAS
SUPPLY BIAS

OFF
IMAGE FORMATION OPERATION
OFF

<COMPULSIVE CONSUMPTION MODE>

SUPPLY BIAS
VOLTAGE (V)
T
T1
W3
480
(V1b)
0
TIME(ms)
-320
-1120
(V1a)
VB11

SUPPLY BIAS
VOLTAGE (V)
T
T1
W4
480
(V2b)
0
TIME(ms)
-320
-920
(V2a)
VB21

VOLTAGE (V)
480
0
TIME(ms)
-320
-920
-1120
200V
SUPPLY BIAS
DEVELOPING BIAS

OFF
COMPULSIVE CONSUMPTION OPERATION
OFF

FIG.7

2081

| ENVIRONMENT | DIFFERENCE OF BIAS VOLTAGES(V) |
|---|---|
| OTHER THAN HIGH-TEMPERATURE AND HUMIDITY | 200 |
| HIGH-TEMPERATURE AND HUMIDITY | 100 |

FIG.8

2091

| CUMULATIVE PRINT COUNT | DUTY RATIO (T1/T) | OPERATION TIME (SEC) |
|---|---|---|
| 1～10000 | Dt1(=0.3) | t1 |
| 10001～20000 | Dt2(<Dt1) | t2(>t1) |
| 20001～30000 | Dt3(<Dt2) | t3(>t2) |
| ⋮ | ⋮ | ⋮ |

NEW TONER

AFTER PREDETERMINED COUNT OF PRINTING HAS BEEN PERFORMED

<COMPULSIVE CONSUMPTION MODE>

DEVELOPING BIAS
VOLTAGE (V)
T
T1
W5
480
(V1b)
0
-320
-1120
(V1a)
TIME (ms)
VB11

SUPPLY BIAS
VOLTAGE (V)
W6
380
(V2b)
0
-320
-720
(V2a)
TIME (ms)
VB21

VOLTAGE (V)
DEVELOPING BIAS
SUPPLY BIAS
480
380
100V
0
-320
-720
-1120
400V
TIME (ms)
SUPPLY BIAS
DEVELOPING BIAS

DEVELOPMENT APPARATUS, IMAGE FORMING APPARATUS AND IMAGE FORMING METHOD FOR CONSUMING DEGRADED TONER

This application is based on application No. 2007-177542 filed in Japan, the contents of which are hereby incorporated by reference.

BACKGROUND OF THE INVENTION

[1] Field of the Invention

The present invention relates to a development apparatus, an image forming apparatus and the like that develop a latent image formed on the image carrier with toner.

[2] Related Art

Some development apparatuses of image forming apparatuses have, for example, a developer roller and a doctor blade that comes in contact with the surface of the developer roller to regulate the amount of toner held thereon. These development apparatuses frictionally charge the toner by the doctor blade or the like to hold the frictionally charged toner on the surface of the developer roller, and develop a latent image on a photoreceptor drum with the toner. Such a development apparatus includes not only toner having a normal charging characteristic (normally charged toner), but also a considerable amount of toner whose charging characteristic has been degraded by abrasion due to friction or the like (degraded toner). This degraded toner includes toner charged with a polarity opposite to the normal polarity (reversely charged toner). Compared to the normally charged toner, the degraded toner is less likely to serve for development, and accordingly tends to remain in the development apparatus. An increase in the amount of the degraded toner remaining in the development apparatus poses a problem for the development, leading to degradation in image quality.

Regarding this problem, Japanese Laid-Open Patent Application No. 2004-170651 discloses a technology for compulsively consuming the degraded toner. Specifically, for instance, when a negative (minus) polarity is the charging polarity of the normally charged toner, a direct-current bias voltage (e.g. −300 V) is applied to the developer roller and at the same time, a direct-current bias voltage (e.g. −500 V) is also applied to the doctor blade. Herewith, the normally charged toner is attracted to the surface of the developer roller while the reversely charged toner is attracted to the doctor blade.

In this state of things, when the developer roller rotates, a layer of the normally charged toner is formed on the surface of the developer roller by electrostatic forces, and a part of the reversely charged toner attracted to the doctor blade adheres on top of the normally charged toner layer to thereby form a layer of the reversely charged toner. By development, the reversely charged toner on the developer roller is moved to the photoreceptor drum, and then cleaned therefrom by a cleaner.

This technology, however, still leaves a problem. That is, since the reversely charged toner is attracted to the doctor blade by electrostatic forces, only a part of the reversely charged toner is actually discharged from the developer roller via the photoreceptor drum, and a lot of reversely charged toner is left behind in the development apparatus.

SUMMARY OF THE INVENTION

The present invention aims at offering a development apparatus capable of effectively consuming the degraded toner, an image forming apparatus equipped with this development apparatus, and a development method.

This object is realized by a development apparatus that develops an electrostatic latent image formed on an image carrier. The development apparatus comprises: a developer roller operable to carry toner on a circumferential surface thereof and develop the electrostatic latent image using the toner; a supply roller operable to perform toner supply to the developer roller; a voltage applier operable to apply a bias voltage V1 to the developer roller and apply a bias voltage V2 to the supply roller; and a controller operable to control the voltage applier in a toner compulsive consumption mode so that a value obtained by subtracting an average S2 of the bias voltage V2 per unit time from an average S1 of the bias voltage V1 per unit time indicates a same polarity as a normal charging polarity of the toner, the toner compulsive consumption mode performing development to compulsively consume the toner carried on the circumferential surface.

Thus, by controlling the bias voltage V1 applied to the developer roller and the bias voltage V2 applied to the supply roller, it is possible to attract, in the toner compulsive consumption mode, a larger amount of reversely charged toner charged with a polarity opposite to the normal charging polarity to the developer roller by electrostatic forces. Herewith, the consumption of degraded toner can be improved as compared to as compared to the conventional technique.

This object is realized by an image forming apparatus including a developer operable to develop an electrostatic latent image formed on an image carrier with use of toner, wherein the developer is the development apparatus.

This object is realized by a development method used on a development apparatus including a developer roller for developing an electrostatic latent image formed on an image carrier with use of toner carried on a circumferential surface of the developer roller and a supply roller for performing toner supply to the developer roller, in order to compulsively consume the toner carried on the circumferential surface. The development method includes a control step of controlling a voltage applier that applies a bias voltage V1 to the developer roller and applies a bias voltage V2 to the supply roller in a toner compulsive consumption mode so that a value obtained by subtracting an average S2 of the bias voltage V2 per unit time from an average S1 of the bias voltage V1 per unit time indicates a same polarity as a normal charging polarity of the toner.

BRIEF DESCRIPTION OF THE DRAWINGS

These and other objects, advantageous effects and features of the invention will become apparent from the following description thereof taken in conjunction with the accompanying drawings which illustrate specific embodiments of the invention. In the drawings:

FIG. 7 shows an example of bias voltage information;

FIG. 8 shows an example of toner compulsive consumption operation information;

DESCRIPTION OF THE PREFERRED EMBODIMENTS

The following explains embodiments of the present invention, a development apparatus and an image forming apparatus, taking a tandem color digital printer (hereinafter referred to simply as "printer") as example.

Embodiment 1

(1) Overall Configuration of Printer

Figure 1:
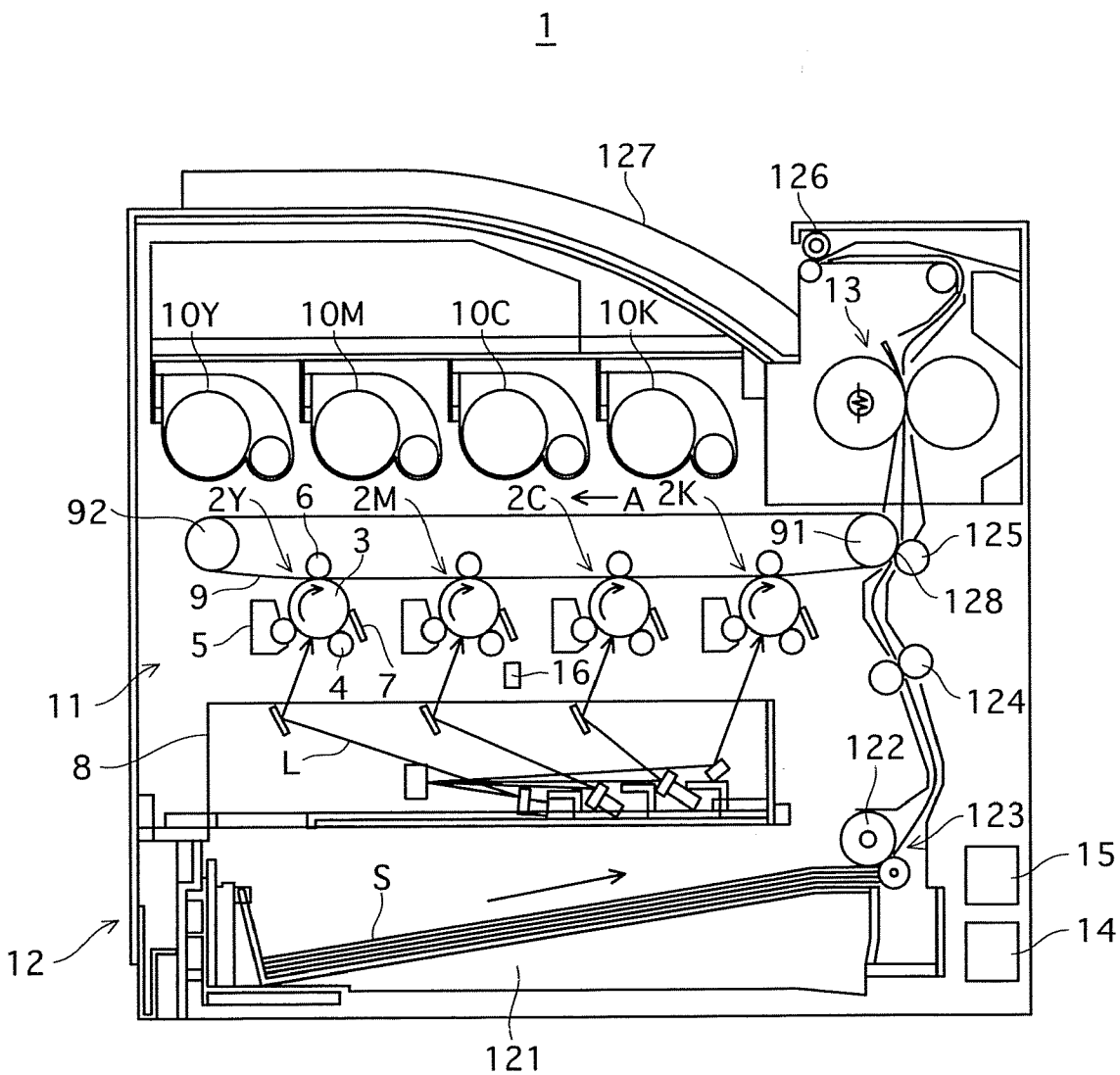
FIG. 1 shows an overall configuration of a printer of Embodiment 1.

FIG. 1 shows the overall configuration of a printer 1.

As shown in the figure, the printer 1 includes an image processing unit 11, a feeder 12, a fuser 13, a controller 14 and a power supply 15, and is connected to a network (e.g. LAN). When receiving an instruction of executing a print job from an external terminal apparatus (not shown), the printer 1 executes a process for forming a color image made up of yellow, magenta, cyan, and black colors in accordance with the instruction. In the following, reproduced colors of yellow, magenta, cyan and black are denoted as Y, M, C and K, respectively.

The image processing unit 11 includes: imaging units 2Y, 2M, 2C and 2K corresponding to Y, M, C and K colors, respectively; an optical unit 8; an intermediate transfer belt 9; and hoppers 10Y, 10M, 10C and 10K.

The imaging unit 2Y includes: a photoreceptor drum 3; a charger 4; a developer 5; a primary transfer roller 6; and a cleaner 7 for cleaning the photoreceptor drum 3. The charger 4, developer 5, primary transfer roller 6 and cleaner 7 are all disposed at the circumference of the photoreceptor drum 3. The imaging unit 2Y forms a Y-color toner image on the photoreceptor drum 3. Similar applies to other imaging units 2M-2K. Note that reference numerals for the components of the imaging units 2M-2K are omitted from the figure.

The optical unit 8 has a light-emitting device, such as a laser diode, and emits laser light L to expose the photoreceptor drum 3 of each color.

The intermediate transfer belt 9 is an endless belt, and lays across a drive roller 91 and a driven roller 92 and is rotatably driven in the direction indicated by arrow A.

The hoppers 10Y-10K house replenishment toner of Y-K colors, respectively, and supply toner to the developer 5 of a corresponding color according to need.

The feeder 12 includes: a paper feeder cassette 121 housing therein sheets of paper S used for recording; a supply roller 122 for supplying the paper S in the paper feeder cassette 121 piece by piece to a paper path 123; paired timing rollers 124 for adjusting the timing of sending the supplied paper S out to a secondary transfer position 128; and a secondary transfer roller 125.

The controller 14 converts image signals sent from an external terminal apparatus into Y-K color digital signals, and generates drive signals for driving the light-emitting device of the optical unit 8. In accordance with the drive signals sent from the controller 14, the optical unit 8 emits the laser light L to exposure-scan the photoreceptor drum 3 of each color.

Before the exposure-scanning, the photoreceptor drums 3 are, with respect to each of the imaging units 2Y-2K, charged uniformly with a predetermined potential (e.g. DC-450V) having a predetermined polarity (e.g. negative) by the corresponding chargers 4. Then, by exposure-scanning with the laser light L, an electrostatic latent image is formed on each photoreceptor drum 3.

Each electrostatic latent image is developed by the developer 5 of a corresponding color. In the present embodiment, toner with the normal charging polarity being negative is used, and toner images of Y-K colors are formed on the photoreceptor drums 3 of the respective colors by so-called reversal development.

The toner images of the respective colors are primarily transferred onto the intermediate transfer belt 9 sequentially due to electrostatic forces acting between the corresponding primary transfer rollers 6 and photoreceptor drums 3. At this point, the image formation operation of each color is performed at a slightly different timing so that all the toner images are transferred and superimposed on top of one another at the same position on the intermediate transfer belt 9. The respective toner images superimposed on the intermediate transfer belt 9 are moved to the secondary transfer position 128 by the rotation of the intermediate transfer belt 9.

In accordance with the timing of the image formation operation, the paper S is supplied from the feeder 12 via the paired timing rollers 124. The paper S is fed while being sandwiched in between the rotating intermediate transfer belt 9 and the secondary transfer roller 125, and all the toner images on the intermediate transfer belt 9 are secondarily transferred together onto the paper S by electrostatic forces acting between the secondary transfer roller 125 and the drive roller 91.

The paper S passed the secondary transfer position 128 is fed to the fuser 13, at which the toner images are heated and pressured to he thereby fixed onto the paper S. Subsequently, the paper S is ejected via an ejection roller 126 and placed in a receiving tray 127.

The power supply 15 supplies a bias voltage VB having a rectangular wave to each developer 5 of the respective imaging units 2Y-2K in accordance with an instruction from the controller 14. The bias voltage VB is later described in detail.

The image processing unit 11 is equipped with a temperature and humidity sensor 16 that detects temperature and humidity of the inside of the apparatus. The detection signal of the temperature and humidity sensor 16 is sent to the controller 14.

(2) Configuration of Developer 5

Figure 2:
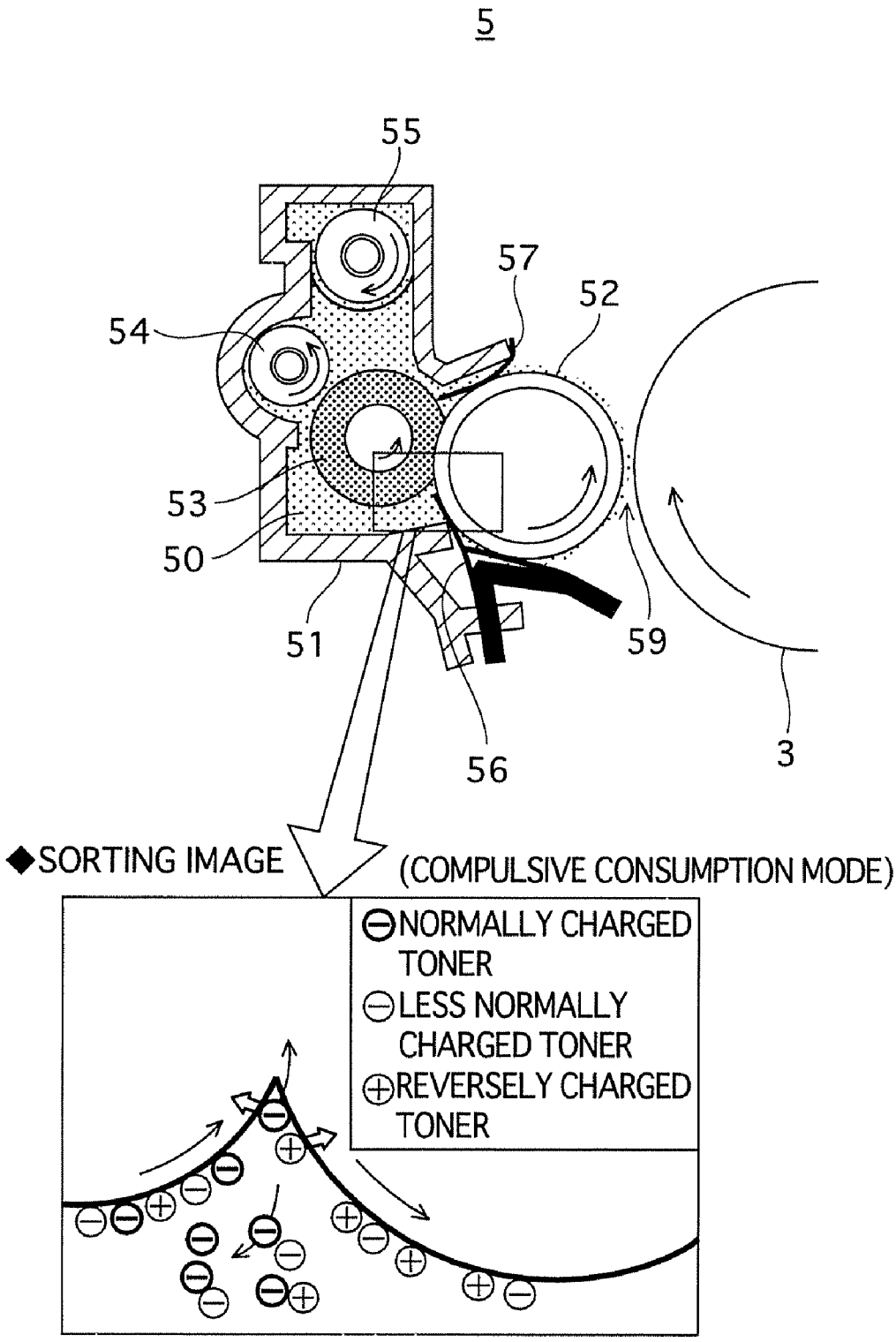
FIG. 2 is a cross sectional view showing a configuration of a developer of the printer.

FIG. 2 is a cross sectional view showing the configuration of the developer 5.

As shown in the figure, the developer 5 includes a housing 51, a developer roller 52, a supply roller 53, an agitation rollers 54 and 55, a doctor blade 56 and an electricity removal sheet 57. Each of the developer roller 52 and other rollers is freely rotatably mounted to the housing 51, and rotates in the direction of the arrow in the figure by drive forces from a drive mechanism (not shown). The following explains the developer 5 of Y-color.

The housing 51 is filled with Y-color toner 50 used as a developer. The toner 50 includes, as shown in the figure, normally charged toner, less normally charged toner and reversely charged toner. The normally charged toner and reversely charged toner are the same as those described in the section of Related Art above. The less normally charged toner is toner having the same polarity as that of the normally charged toner, but having such a small electric charge that would have an adverse effect on the image quality. In the present embodiment, since the normal charging polarity of the toner is negative, the normally charged toner and less normally charged toner have a negative polarity while the reversely charged toner has a positive polarity. The less normally charged toner is hereinafter referred to simply as "low charged toner", and the low charged toner and reversely charged toner are collectively referred to as "degraded toner".

The developer roller 52 is placed opposite to the photoreceptor drum 3, carries thereon the toner 50 and delivers it to a development position 59. At the development position 59, the toner 50 on the developer roller 52 is moved to an exposed portion on the photoreceptor drum 3. Herewith, a toner image of Y-color is formed on the photoreceptor drum 3 (an electrostatic latent image is developed). As the developer roller 52, a roller may be used which is made, for example, by providing a thin-film resin layer having a predetermined resistance on a cored bar made of metal.

The supply roller 53 is placed opposite to the developer roller 52. Abutting on the surface of the developer roller 52, the supply roller 53 is provided to rotate in the counter direction to the developer roller at the abutting region. The supply roller 53 thereby supplies the toner 50 in the housing 51 to the developer roller 52. Also, the supply roller 53 corrects the toner 50 after passing through the electricity removal sheet 57 from the developer roller 52 and brings back in the housing 51. As the supply roller 53, a roller may be used which is made, for example, by depositing an expandable elastic member on the surface of a roller made of metal.

The doctor blade 56 is disposed in a manner that the tip portion and its adjacent portion are brought into contact with the surface of the developer roller 52. The doctor blade 56 regulates the amount of toner passing through the space between itself and the surface of the developer roller 52 so as to form a uniform and thin layer of the toner 50 on the developer roller 52.

The electricity removal sheet 57 is for removing electricity from the toner 50 on the developer roller 52, after passing the development position 59. The electricity removal sheet 57 reduces the electrostatic adherence of the toner 50 to the developer roller 52 before the toner 50 is brought back in the housing 51, so that the toner 50 becomes readily detached from the surface of the developer roller 52. In addition, the electricity removal sheet 57 functions as an ejection prevention member that prevents the toner 50 from being ejected to the outside of the housing 51.

The agitation rollers 54 and 55 agitate the toner 50 in the housing 51 to prevent it from becoming solidified and maintain its fluidity.

On the housing 51, a replenishment port (not shown) for receiving replenishment toner from the hopper 10Y is provided. When the toner 50 in the housing 51 is consumed by development, the toner 50 is replenished from the hopper 10Y to thereby maintain a substantially steady amount of toner in the housing 51. Although the configuration of the developer 5Y is explained above, the remaining developers 5M-5K have the same configuration as the developer 5Y and their descriptions are therefore omitted here.

(3) Configuration of Controller 14

Figure 3:
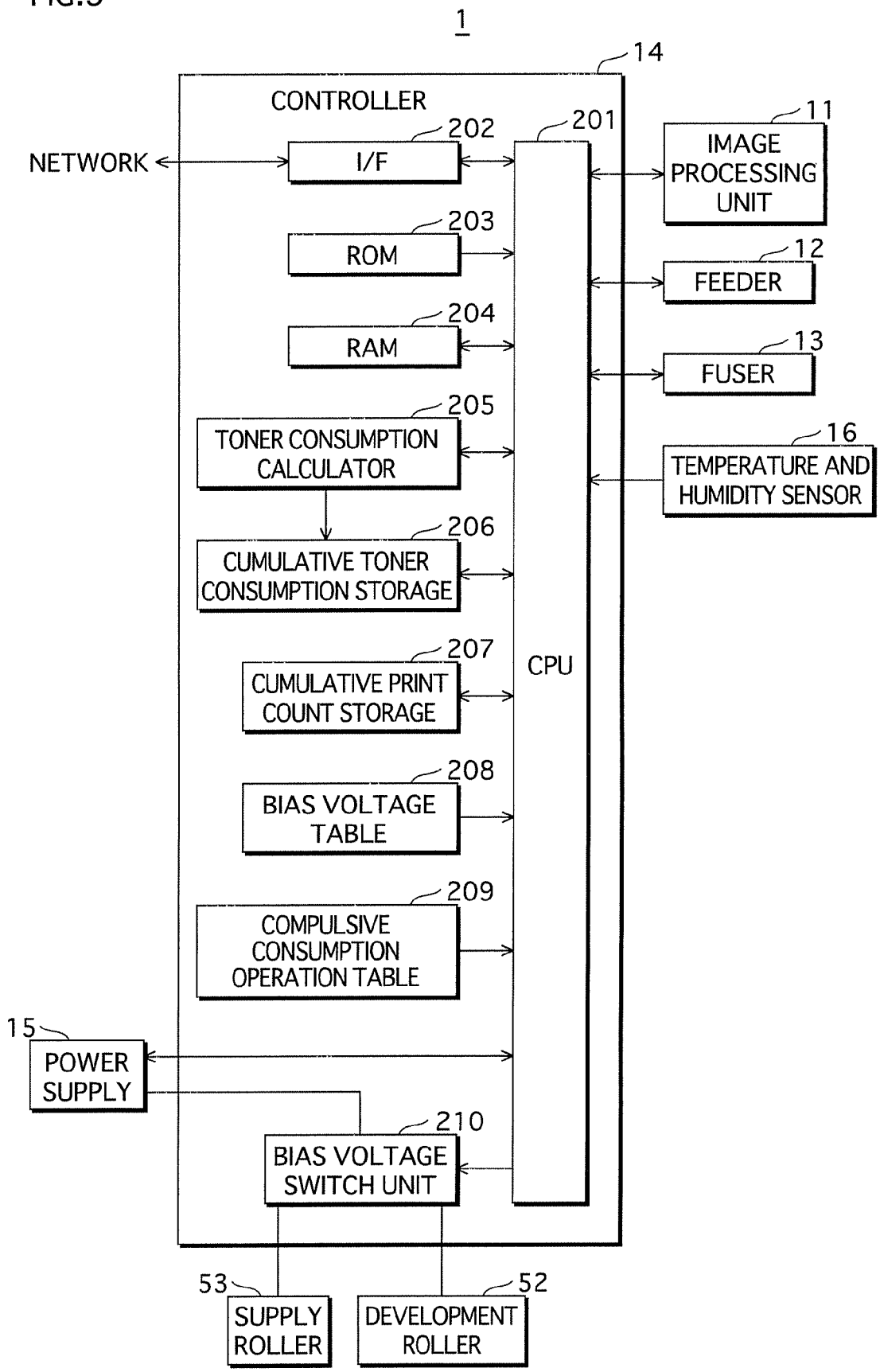
FIG. 3 is a block diagram showing a configuration of a controller of the printer.

FIG. 3 is a block diagram showing the configuration of the controller 14.

As shown in the figure, the controller 14 includes, as main components: a CPU 201; a communication interface (I/F) 202; a ROM 203; a RAM 204; a toner consumption calculator 205; a cumulative toner consumption storage 206; a cumulative print count storage 207; a bias voltage table 208; a compulsive consumption operation table 209; and a bias voltage switch unit 210. These main components are able to exchange data with each other.

The communication I/F 202 is an interface for making connections to a LAN, such as a LAN card or a LAN board.

The CPU 201 reads a necessary program from the ROM 203, and performs unified controls while timing operations of the image processing unit 11 and the like to thereby realize a smooth image formation process. Also, at the time of non-image formation other than image formation based on a print job externally sent thereto, toner compulsive consumption is performed that causes degraded toner in the developer 5 to be compulsively discharged (consumed) to the outside.

The toner compulsive consumption is performed with respect to each of the imaging units 2Y-2K. For example, in the case of the imaging unit 2Y, the toner 50 carried on the surface of the developer roller 52 is moved to the photoreceptor drum 3 by development. Specifically speaking, data of an image to be formed on the photoreceptor drum 3 at the time of the toner compulsive consumption has been prestored, then exposure-scanning based on the data is performed to thereby form a latent image of the image on the photoreceptor drum 3, and the formed latent image is developed. Since a voltage not realizing a transfer operation is applied to the primary transfer roller 6, or no voltage is applied thereto, the toner 50 moved from the developer roller 52 to the photoreceptor drum 3 is not transferred to the intermediate transfer belt 9, and cleaned by the cleaner 7. This operation is the same for the remaining imaging units 2M-2K. Hereinafter, the execution of image formation based on a print job is referred to as "execution of an image formation mode", and the execution of toner compulsive consumption is referred to as "execution of a toner compulsive consumption mode".

The ROM 203 stores therein a control program for executing the image formation mode, a program for executing the toner compulsive consumption mode and the like. The RAM 204 is used as a work area at the time of the CPU 201 executing a program.

The toner consumption calculator 205 calculates, with respect to each sheet of paper, the amount of toner consumed for the image formation in the image formation mode. Specifically speaking, a method may be adopted in which, when an electrostatic latent image is formed by exposing the photoreceptor drum 3 of each color on a pixel-by-pixel basis, the number of the exposed pixels for each color is counted for the sheet of paper to find the total count. Alternatively, the amount of consumed toner may be calculated based, for example, on the number of times of toner replenishment and the time required for replenishment from the hoppers 10Y-10K for each color.

The toner consumption calculator 205 adds, with respect for each color, the calculated amount of consumed toner to the amount actually stored in the cumulative toner consumption storage 206, and rewrites (i.e. updates) the stored amount with a new amount of consumed toner obtained by the addition.

The cumulative toner consumption storage 206 is formed by a nonvolatile memory or the like, and stores therein a value indicating a presently accumulated amount of the consumed toner.

The cumulative print count storage 207 is formed by a nonvolatile memory or the like, and stores therein a value indicating the total number of sheets of paper having been printed up to the present time (cumulative number of printed sheets). The cumulative number of printed sheets is updated by that the current cumulative number is increased by the CPU 201 by "1" each time the printing of one sheet of paper S is finished.

The bias voltage table 208 is formed by a nonvolatile memory or the like, and stores therein information pertaining to bias voltages in the toner compulsive consumption mode (bias voltage information). Also, the compulsive consumption operation table 209 is formed by a nonvolatile memory or the like, and stores therein information pertaining to an operation of the toner compulsive consumption (compulsive consumption operation information). The details of the bias voltage information and compulsive consumption operation information are described later.

The bias voltage switch unit 210 includes a circuit letting the bias voltage VB from the power supply 15 through as it is and a circuit performing a voltage conversion on the bias voltage VB. In the image formation mode, the bias voltage switch unit 210 applies, in response to an instruction from the CPU 201, the let-through voltage to the supply roller 53 and the converted voltage to the developer roller 52 with respect to each of the imaging units 2Y-2K. In the toner compulsive consumption mode, the bias voltage switch unit 210 applies the let-through voltage to the developer roller 52 and the converted voltage to the supply roller 53. The configuration of the bias voltage switch unit 210 is later described.

(4) Waveforms of Bias Voltages

FIG. 4 shows an example of waveforms of bias voltages in the image formation mode, and FIG. 5 shows an example of waveforms of bias voltages in the toner compulsive consumption mode. These figures depict the case of the imaging unit 2Y; however, the same basically applies to the remaining image units 2M-2K. The following explains voltage waveforms of each mode, comparing these figures.

(4-1) Image Formation Mode

Figures 4A, 4B, 4C, 4D:
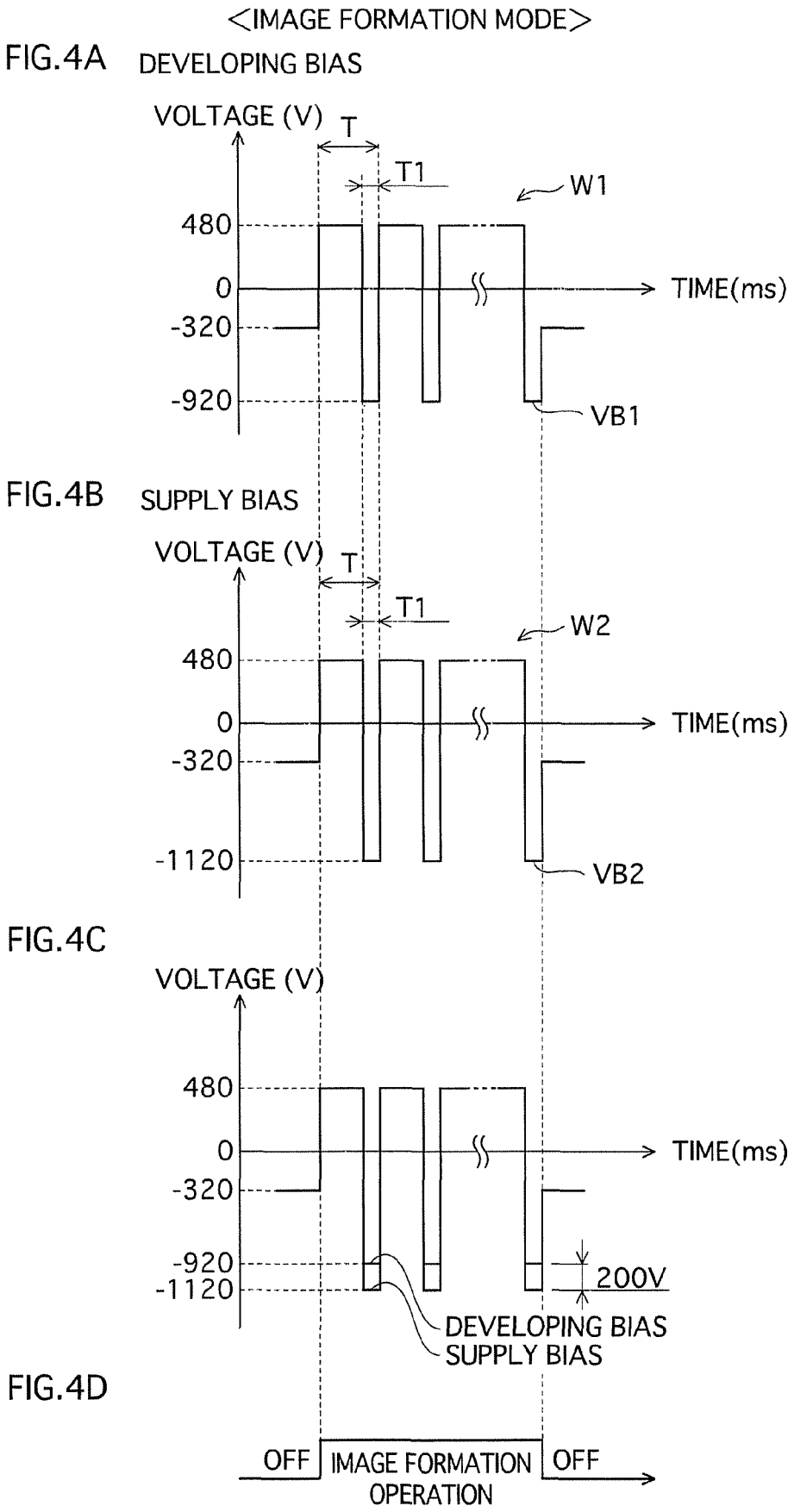
FIG. 4 shows an example of waveforms of bias voltages in an image formation mode.

FIG. 4A shows a waveform W1 of a developing bias voltage VB1 applied to the developer roller 52; FIG. 4B shows a waveform W2 of supply bias voltage VB2 applied to the supply roller 53; FIG. 4C shows the waveforms W1 and W2 superimposed on top of each other; and FIG. 4D shows an application timing of the developing bias voltage VB1 and supply bias voltage VB2.

As shown in FIG. 4A, the developing bias voltage VB1 has a waveform composed by superimposing, as an AC component, a rectangular wave onto direct-current voltage whose DC component is −320 [V]. The rectangular wave has a reference level of −320 [V], and continually oscillates to the positive side by up to 800 [V] from the reference level and to the negative side by up to 600 [V] from the reference level. The rectangular wave has a frequency of 2 [kHz] (one cycle T=500 [μsec.]) and a duty ratio (T1/T) of 0.3 (T1=150 [μsec.]).

As shown in FIG. 4B, the supply bias voltage VB2 has a waveform composed by superimposing, onto direct-current voltage whose DC component is −320 [V], a rectangular wave with a peak-to-peak value of 1600 [V], a frequency of 2 [kHz] and a duty ratio of 0.3 as an AC component.

As shown in FIG. 4C, the phases of the developing bias voltage VB1 and supply bias voltage VB2 are synchronized. These bias voltages VB1 and VB2 have the same peak value on the positive side; however, on the negative side, the peak value of the developing bias voltage VB1 is 200 [V] higher than that of the supply bias voltage VB2. Herewith, a larger amount of normally-charged toner of Y-color can be carried on the developer roller 52.

That is, the normally charged toner has a negative polarity. Accordingly, when positioned between the developer roller 52 and supply roller 53, the normally charged toner is attracted to the developer roller 52 having a higher potential due to electrostatic forces. On the other hand, since having a positive polarity, the reversely charged toner is attracted to the supply roller 53 with a lower potential. Regarding the low charged toner, although it has a negative polarity, the electric charge has been reduced. As a result, the low charged toner is less attracted to the developer roller 52, as compared to the normally charged toner. Accordingly, the low charged toner is more difficult to be collected on the developer roller 52 than the normally charged toner, resulting in that a smaller amount of the low charged toner is attracted to the developer roller 52.

To the developer roller 52, a large amount of the normally charged toner is attracted by strong electrostatic forces. Accordingly, it is less likely that the low charged toner would slip through the doctor blade 56 by pushing the normally charged toner away to be then carried on the surface of the developer roller 52.

Herewith, the ratio of the normally charged toner to the entire toner on the developer roller 52 can be increased. However, due to various development conditions such as the bias voltage values, the toner charging characteristics, and gaps between rollers, it is sometimes the case that a certain amount of the degraded toner is mixed in the toner on the developer roller 52, or the degraded toner is rarely mixed therein. This theory can be applied to the case of causing a larger amount of degraded toner to be carried on the developer roller 52 in the toner compulsive consumption mode to be later described.

As shown in FIG. 4D, the developing bias voltage VB1 and supply bias voltage VB2 are applied during the execution of development in the image formation mode. The waveforms of the developing bias voltage VB1 and supply bias voltage VB2 are set as shown by W1 and W2, respectively. Herewith, in development, the toner 50 carried on the developer roller 52 is, at the development position 59, moved to an exposed portion on the photoreceptor drum 3 to form a toner image-that is, to develop the latent image into a toner image.

(4-2) Toner Compulsive consumption Mode

Figures 5A, 5B, 5C, 5D:
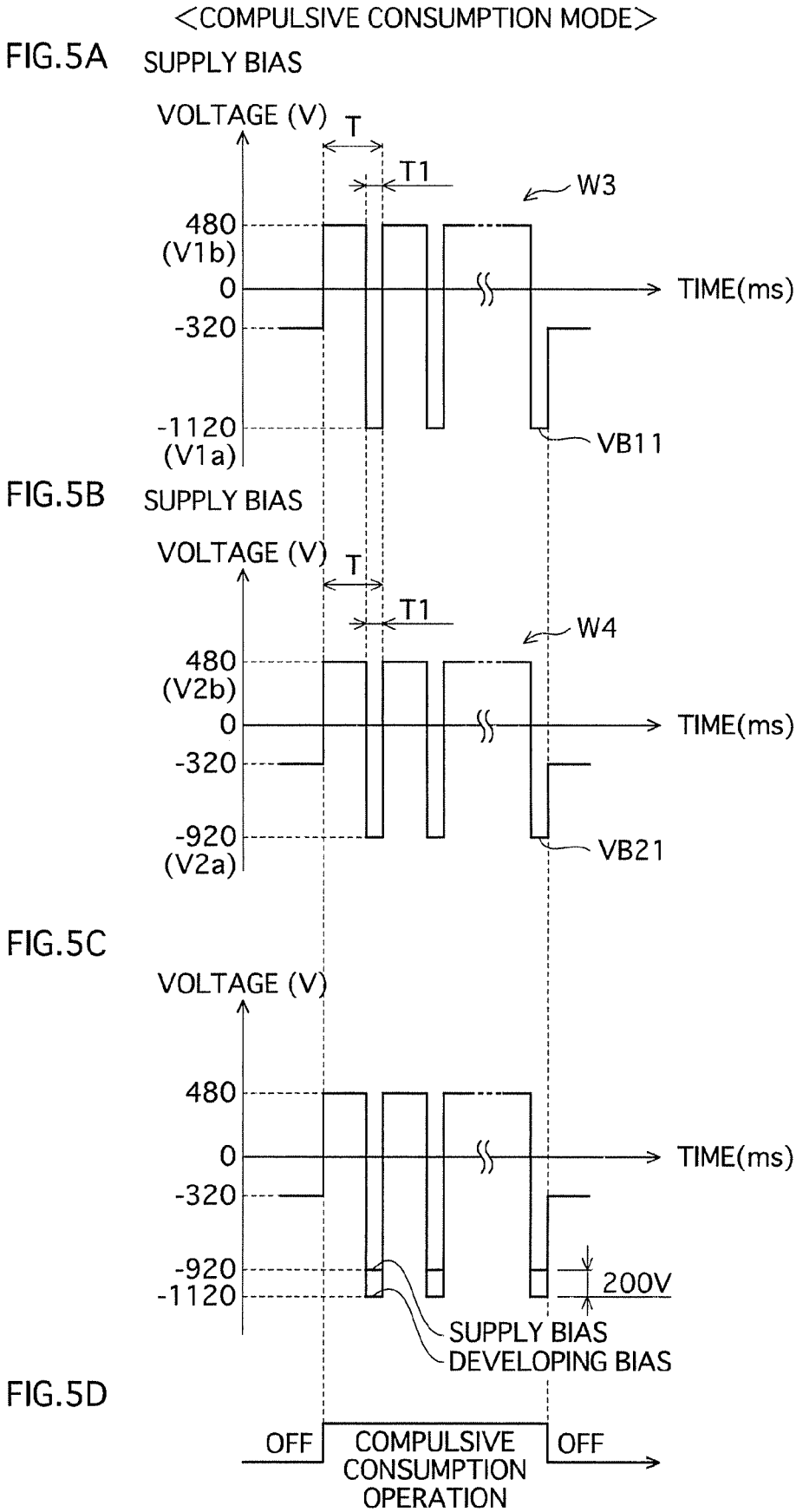
FIG. 5 shows an example of waveforms of bias voltages in a toner compulsive consumption mode.

FIG. 5A shows a waveform W3 of developing bias voltage VB11 applied to the developer roller 52; FIG. 5B shows a waveform W4 of supply bias voltage VB21 applied to the supply roller 53; FIG. 5C shows the waveforms W3 and W4 superimposed on top of each other; and FIG. 5D shows a timing of application of the developing bias voltage VB11 and supply bias voltage VB21.

As shown in FIG. 5A, the developing bias voltage VB11 has a waveform composed by superimposing, onto direct-current voltage whose DC component is −320 [V], a rectangular wave with a peak-to-peak value of 1600 [V], a frequency of 2 [kHz] and a duty ratio of 0.3 as an AC component. The waveform W3 is the same as the waveform W2 of the supply bias VB2 in the image formation mode.

As shown in FIG. 5B, the supply bias voltage VB21 has the same waveform as the waveform W3, except for the peak value on the negative side. That is, the negative-side peak value of the waveform W4 is 200 [V] higher (i.e. −920 [V]) than that of the waveform W3. The waveform W4 is the same as the waveform W1 of the developing bias voltage VB1 in the image formation mode.

As shown in FIG. 5C, the phases of the waveforms W3 and W4 are synchronized, and the magnitude relation of the voltages is opposite as compared to in the image formation mode-that is, on the positive side, peak values (V1*b* and V2*b*) are the same and, on the negative side, a peak value (V2*a*) of the supply bias voltage VB21 is 200 [V] higher than a peak value (V1*a*) of the developing bias voltage VB11. Since, within one cycle, the bias voltages are different only on the negative side, a voltage difference of 200 [V] periodically exists between the developer roller 52 and supply roller 53.

Thus, by reversing the magnitude relation of the negative-side peak values used in the image formation mode, a larger amount of degraded toner of Y-color can be carried on the developer roller 52 in the toner compulsive consumption mode. This is attributable to the following factors.

That is, as shown in the sorting image of FIG. 2 (schematic diagram), when positioned between the developer roller 52 and supply roller 53, the normally charged toner having a negative polarity is attracted to the supply roller 53 having a higher potential. On the other hand, since having a positive polarity, the reversely charged toner is attracted to the developer roller 52 having a lower potential. Regarding the low charged toner, although it has a negative polarity, the electric charge has been reduced. As a result, the low charged toner is less attracted to the supply roller 53, as compared to the normally charged toner. Accordingly, the low charged toner is more difficult to be collected on the supply roller 53 than the normally charged toner, resulting in that a smaller amount of low charged toner is attracted to the supply roller 53.

In the case where a large amount of reversely charged toner is present in the housing 51, a lot of reversely charged toner is attracted to the developer roller 52 by strong electrostatic forces. Accordingly, it is less likely that the low charged toner would slip through the doctor blade 56 by pushing the reversely charged toner away to be then carried on the surface of the developer roller 52. On the other hand, in the case where only a small amount of reversely charged toner is present, not much reversely charged toner is attracted to the developer roller 52, making it more likely for the low charged toner to move to the gap between the surface of the developer roller 52 and the doctor blade 56. As a result, the low charge toner moved to the gap is more likely to be passively carried on the developer roller 52 together with the reversely charged toner.

Note that, according to the above theory, it is desirable if most of the toner present on the developer roller 52 is degraded toner. However, it has been understood that the degraded toner is actually less likely to move to the photoreceptor drum 3 by development, as compared to the normally charged toner. Given this factor, in the toner compulsive consumption mode, the difference of the bias voltages, the duty ratio and the like are determined such that the normally charged toner, which is readily moved to the photoreceptor drum 3, is mixed at a certain proportion, as described later.

As shown in FIG. 5D, the developing bias voltage VB11 and supply bias voltage VB21 are applied during the operation time of the toner compulsive consumption (e.g. t1). On the photoreceptor drum 3, a latent image of the image for the toner compulsive consumption is formed as described above, and the latent image is developed at the development position 59 by the toner 50 carried on the developer roller 52. Herewith, the degraded toner is discharged from the developer 5.

Figure 6:
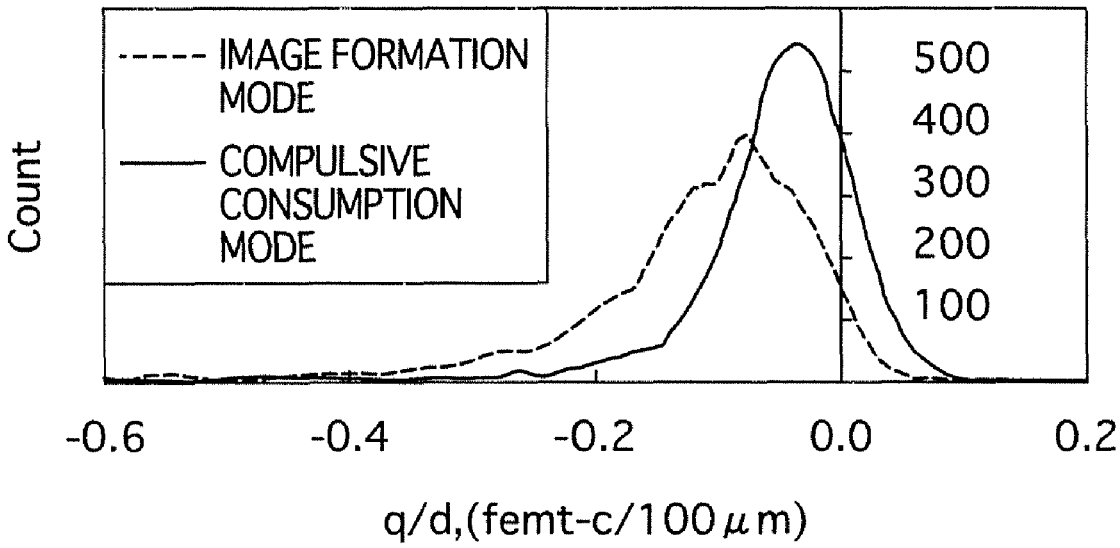
FIG. 6 shows actual measurement results of distribution of electric charge of toner in the image formation mode and the toner compulsive consumption mode.

FIG. 6 shows actual measurement results of distribution of the electric charge of the toner in the image formation mode and the toner compulsive consumption mode. The graph of the figure has been obtained by measuring the toner on the developer roller 52 with a publicly known measuring instrument-here in the present embodiment, E-SPART ANALYZER manufactured by Hosokawa Micron Corporation is used. As shown in the figure, the distribution of the electric charge of the toner is generally shifted to the plus side in the toner compulsive consumption mode, as compared to in the image formation mode, which indicates that toner sorting has been realized.

In the above FIG. 5, the developing bias voltage VB11 and supply bias voltage VB21 of the toner compulsive consumption mode are explained with the example setting where the duty ratio is 0.3, the difference of bias voltages is 200 [V] and the operation time is t1; however, these duty ratio, difference of bias voltages and operation time may be changed according to a predetermined condition as described in the next section.

(5) Bias Voltage Information

FIG. 7 shows an example of bias voltage information 2081.

As shown in the figure, the bias voltage information 2081 is made by an association between the internal environment of the apparatus and the difference of the bias voltages, and indicates that the difference of the bias voltages is changed according to a predetermined condition, such as the internal environment. The bias voltage information 2081 is the same for all the reproduced colors.

The internal environment of the apparatus means the temperature and humidity in the apparatus, and is divided into two categories: a condition of high-temperature and humidity (for example, temperature t≧(30 [(C] and humidity h>85 [%] RH) and a condition other than high-temperature and humidity (e.g. temperature t<30 [(C] and humidity h<85 [%] RH).

The difference of the bias voltages is set smaller for the condition of high-temperature and humidity than for the other condition. This is because, although setting a large voltage difference facilitates, at the imaging unit 2Y, for example, attracting the degraded toner of Y-color to the developer roller 52, the leakage of electric charge tends to occur between the developer roller 52 and the supply roller 53 via the toner 50 under a high-temperature and humidity environment, and the compulsive consumption cannot always be performed when the leakage occurs. Therefore, appropriate values for the difference of the bias voltages are found in advance by an experiment or the like based on the relationship with the leakage, and stored in the bias voltage table 208.

The above gives an example in which the voltage difference is changed for the condition of high-temperature and humidity and the condition other than that; however, the present invention is not limited to this case. The voltage difference may be stepwisely changed, or progressively increased or decreased, according to the temperature and humidity in the apparatus. In addition, the same bias voltage information 2081 is provided for all reproduced colors in the above example; however, an optimum value may be specified for each color instead.

(6) Compulsive consumption Operation Information

FIG. 8 shows an example of compulsive consumption operation information 2091.

As shown in the figure, the compulsive consumption operation information 2091 is made by an association among the cumulative print count, the duty ratio of the bias voltages and the compulsive consumption operation time, and indicates that the duty ratio and the compulsive consumption operation time are changed according to a predetermined condition, such as the cumulative print count. Specifically speaking, the information is set such that the duty ratio decreases and the compulsive consumption operation time increases as the cumulative print count increases. This is in order to prevent the toner's electric charge and flying force to the photoreceptor drum 3 from decreasing due to an increase in the cumulative print count, which in turn would result in a decrease in the consumption of the degraded toner. The following gives a detailed explanation in this regard.

Figure 9A:
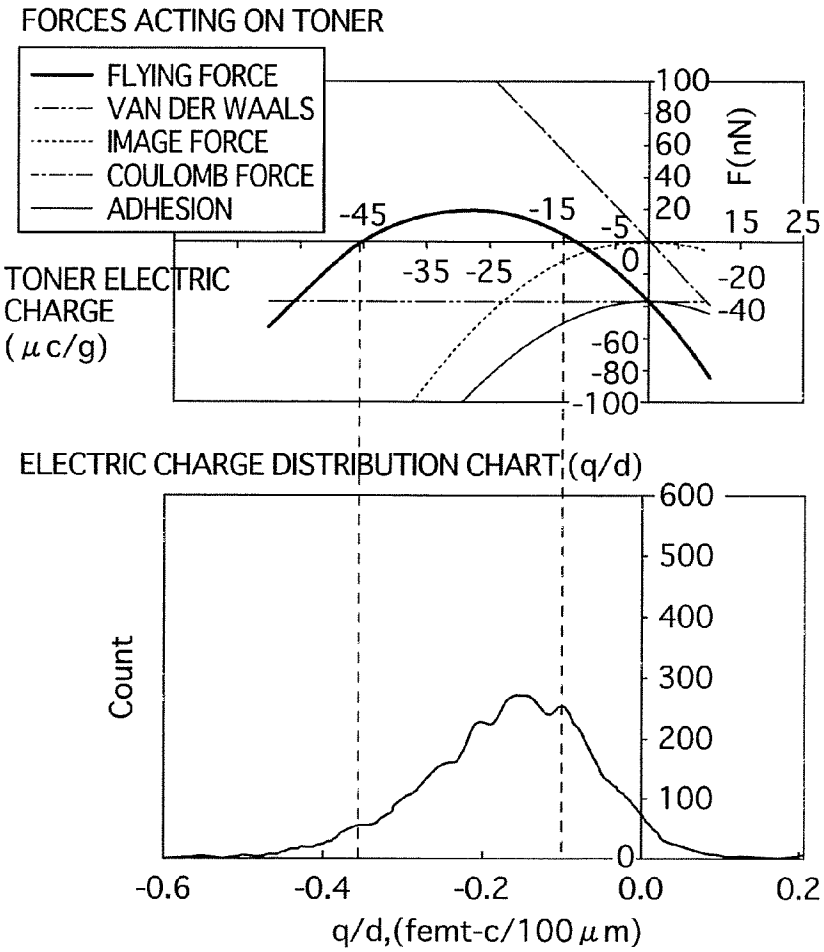
FIG. 9 is a graph showing toner's flying force and distribution of electric charge.
Figure 9B:
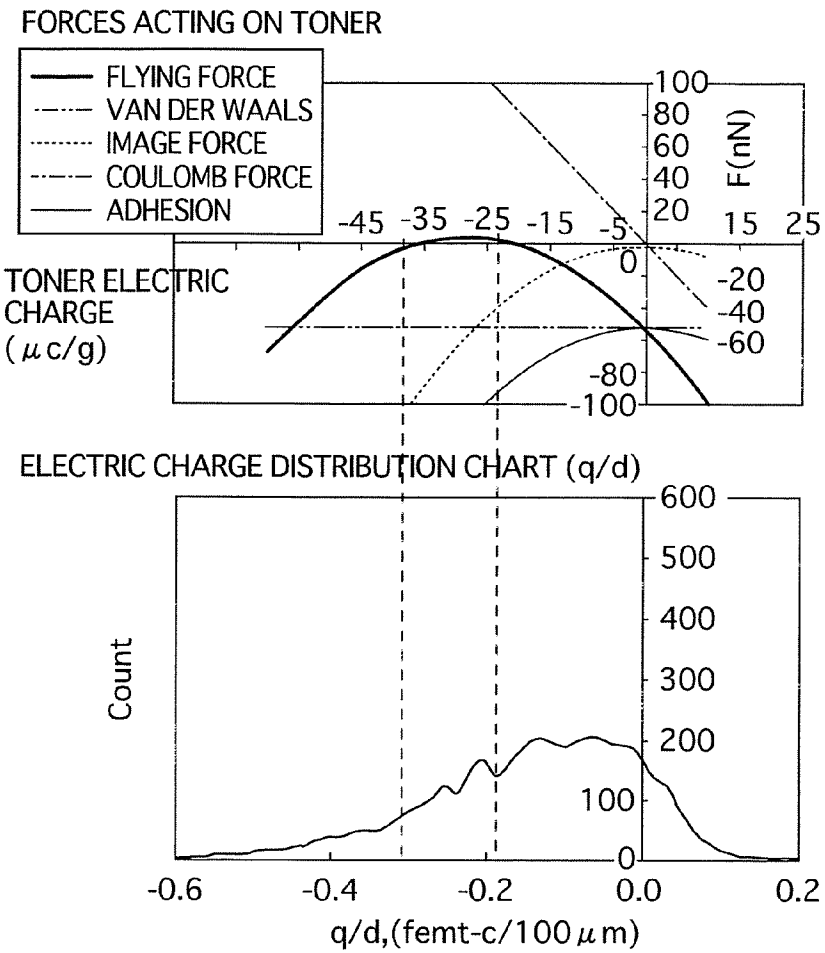

FIG. 9 includes graphs showing the toner's flying force and electric charge distribution. FIG. 9A is regarding new toner; and FIG. 9B is regarding toner with which a predetermined cumulative count of printing has been performed. Although the same graph would basically be obtained for toner of all Y-K colors, an example of Y-color is explained here. The flying force in the figure is obtained by subtracting the van der Waals force, the image force and the adhesion from the Coulomb force. The equation for the flying force is a publicly known calculating formula, and the present embodiment refers it to the description of the study on the toner adhesion in Ricoh Technical Report No. 26 (Research and Development Center of Ricoh Co., Ltd. Issued on Nov. 30, 2000). In addition, the electric charge distribution of the toner was measured using the above measuring instrument.

In the graphs of flying force, the horizontal axis shows the electric charge of the toner and the vertical axis shows forces acting on the toner. For the electric charge of the toner, an electric charge of the toner having a normal charging polarity is indicated by a negative value. For the forces acting on the toner, a force causing the toner to move in the direction from the developer roller 52 toward the photoreceptor drum 3 is indicated by a positive value; and a force causing the toner to move in the direction from the photoreceptor drum 3 toward the developer roller 52 is indicated by a negative value.

It can be seen from both figures that the flying force of the toner with which a predetermined cumulative count of printing has been performed decreased in whole, as compared to the new toner. Additionally, the electric charge distribution of the used toner is generally shifted to the plus side.

The decrease in the flying force is considered attributable to the following factors. An external additive, such as silica, that has been added to enhance the fluidity of the toner is detached or lost from the toner particles due to the friction between the toner particles and between the toner particles and the agitation roller, as the cumulative print count increases. As a result, the toner particles become abraded and deformed, and the van der Waals force, the adhesion and the like increase. In addition, the shift of the electric charge distribution of the toner to the plus side is believed due to an increase in the proportion of the degraded toner particles due to the abrasion and the like.

According to FIG. 9B, the proportion of toner with positive flying force (toner whose electric charge is in the range between two vertical dotted lines) is reduced due to the decrease in the flying force. Toner with positive flying force easily moves to the photoreceptor drum 3 by development, and thus it can be said that a large amount of the normally charged toner is included. On the other hand, toner with negative flying force is difficult to move to the photoreceptor drum 3, and thus it can be said that a large amount of low charged toner and reversely charged toner are included.

In the case of FIG. 9A, since the proportion of the normally charged toner is large, the normally charged toner is also mixed, to some extent, in the toner on the developer roller 52 in the toner compulsive consumption mode. Accordingly, when the normally charged toner moves to the photoreceptor drum 3, it is possible to also move degraded toner electrostatically or mechanically attached to the normally charged toner.

On the other hand, in the case of FIG. 9B, the amount of normally charged toner is less and the proportion of the degraded toner increases to an extreme level. Accordingly, if the toner compulsive consumption is set to the same conditions as in the case of FIG. 9A, a lot of amount of degraded toner is carried on the developer roller 52, and toner difficult to move to the photoreceptor drum 3 increases in ratio on the developer roller 52 and is thus likely to stay behind without being used in development.

Given this factor, as the cumulative print count increases, the duty ratio (T1/T) is reduced(that is, time T1 is shortened while a cycle T remains as it is, and the proportion of normally charged toner in the toner collected to the developer roller 52 is increased (i.e. the proportion of degraded toner is reduced). Herewith, the normally charged toner is increased to some extent, and thereby the consumption of the degraded toner is enhanced.

Additionally, by making the compulsive consumption operation time longer as the cumulative print count increases, it is designed to consume a larger amount of degraded toner building up along with the increase in the cumulative print count. Regarding the compulsive consumption operation information 2091, an appropriate value is individually determined for each color, or a common value is determined for all the colors, in advance based on an experiment or the like.

Note that the flying performance of the toner to the photoreceptor drum 3 may change due to environmental factors such as temperature and humidity. Therefore, the proportion of the normally charged toner is increased or decreased by changing the difference of the bias voltages within the range not causing the leakage of electric charge, and thereby the consumption of the degraded toner can be improved. Specifically speaking, for example, when the flying performance of the toner decreases under the condition of high-temperature and humidity, as compared to a condition other than high-temperature and humidity, the difference of the bias voltages may be set smaller to thereby increase the proportion of the normally charged toner.

In terms of the proportion of the normally charged toner, the efficiency of the compulsive consumption of the degraded toner is reduced if it is too small, and the amount of the normally charged toner consumed together increases if it is too large. Accordingly, in view of these factors, it is desirable to change the bias voltages to obtain an appropriate proportion-for example, 20% or more(of the normally charged toner.

Specifically speaking, the following structure may be adopted. That is, in the case of the amount of printing being less, or being in a normal environment, it is considered that the amount of degraded toner would be less and the proportion of normally charged toner is likely to exceed 20%. Therefore, the bias voltages for reducing the proportion of normally charged toner are applied to make the proportion close to 20%. On the other hand, in the case of the amount of printing being large, the amount of degraded toner increases, which in turn reduces the proportion of normally charged toner. Therefore, the bias voltages for increasing the proportion of normally charged toner are applied to ensure the proportion of 20% or more. The waveform of each bias voltage can be determined in advance from an experiment or the like. It is a matter of course that the appropriate proportion of normally charged toner is not limited to the above-mentioned value. Optimal proportion and bias voltage waveforms are decided according to the amount of printing, environment, charging characteristic of the toner and the like so as to realize efficient consumption of the degraded toner.

(7) Configuration of Bias Voltage Switch Unit 210

Figure 10:
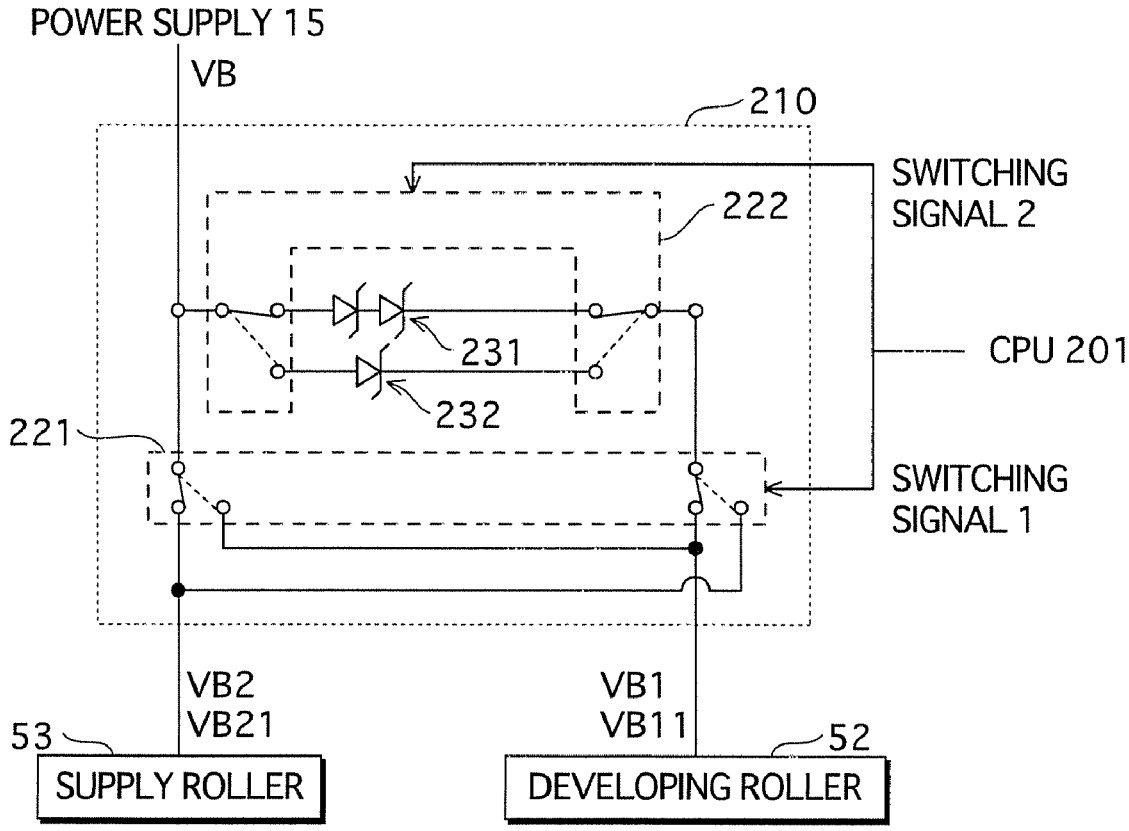
FIG. 10 shows an example of a circuit configuration of a bias voltage switch unit.

FIG. 10 shows an example of the circuit configuration of the bias voltage switch unit 210.

As shown in the figure, the bias voltage switch unit 210 includes switching units 221 and 222 and voltage regulator circuits 231 and 232.

The voltage regulator circuit 231 is a circuit made of two zener diodes connected in series, and is configured so that a voltage difference of 200 [V] occurs between both ends when a reverse-bias voltage is applied thereto. Similarly, the voltage regulator circuit 232 is configured so that a voltage difference of 100 [V] occurs between both ends when a reverse-bias voltage is applied thereto.

According to a switching signal 2 from the CPU 201, the switching unit 222 switches the contacts to the state shown by the solid lines in the image formation mode, and switches the contacts to either one of the states shown by the solid and dotted lines in the toner compulsive consumption mode. According to a switching signal 1 from the CPU 201, the switching unit 221 switches the contacts to the state shown by the solid lines in the image formation mode, and switches the contacts to the state shown by dotted lines in the toner compulsive consumption.

According to the above switching, in the image formation mode, the bias voltage VB from the power supply 15 is passed through to the supply roller 53 of each of the imaging units 2Y-2K (VB2 of FIG. 4B), and rectangular wave voltage whose peak value on only the negative side has been adjusted by the voltage regulator circuit 231 to be 200 [V] higher than the bias voltage VB (VB1 of FIG. 4A) is supplied to the developer roller 52 of each of the imaging units 2Y-2K.

On the other hand, in the toner compulsive consumption mode, the bias voltage VB from the power supply 15 is supplied as it is to each developer roller 52 (VB11 of FIG. 5B), and voltage going through, out of two voltage regulator circuits 231 and 232, a circuit switched by the switching unit 222 is applied to each supply roller 53. Specifically speaking, in the case where switching is made to the voltage regulator circuit 231, the applied voltage has the same peak value on the positive side, as compared to the bias voltage VB, but the peak value on the negative side being 200 [V] higher-i.e. voltage with 480 [V] on the positive side and −920 [V] on the negative side (VB21 of FIG. 5B). When switching is made to the voltage regulator circuit 232, the applied voltage has the peak value on the negative side being 100 [V] higher(i.e. voltage with 480 [V] on the positive side and −1020 [V] on the negative side. In this sense, the power supply 15 and the bias voltage switch unit 210 form a voltage applier that supplies bias voltages to the developer roller 52 and supply roller 53. Note that, in the case where the difference of the bias voltages is changed stepwisely or progressively, the necessary number of voltage regulator circuits for switching may be provided. Alternatively, as the power supply 15, one having a mechanism for varying voltage to output it at a required magnitude may be used.

(8) Process in Toner Compulsive consumption Mode

Figure 11:
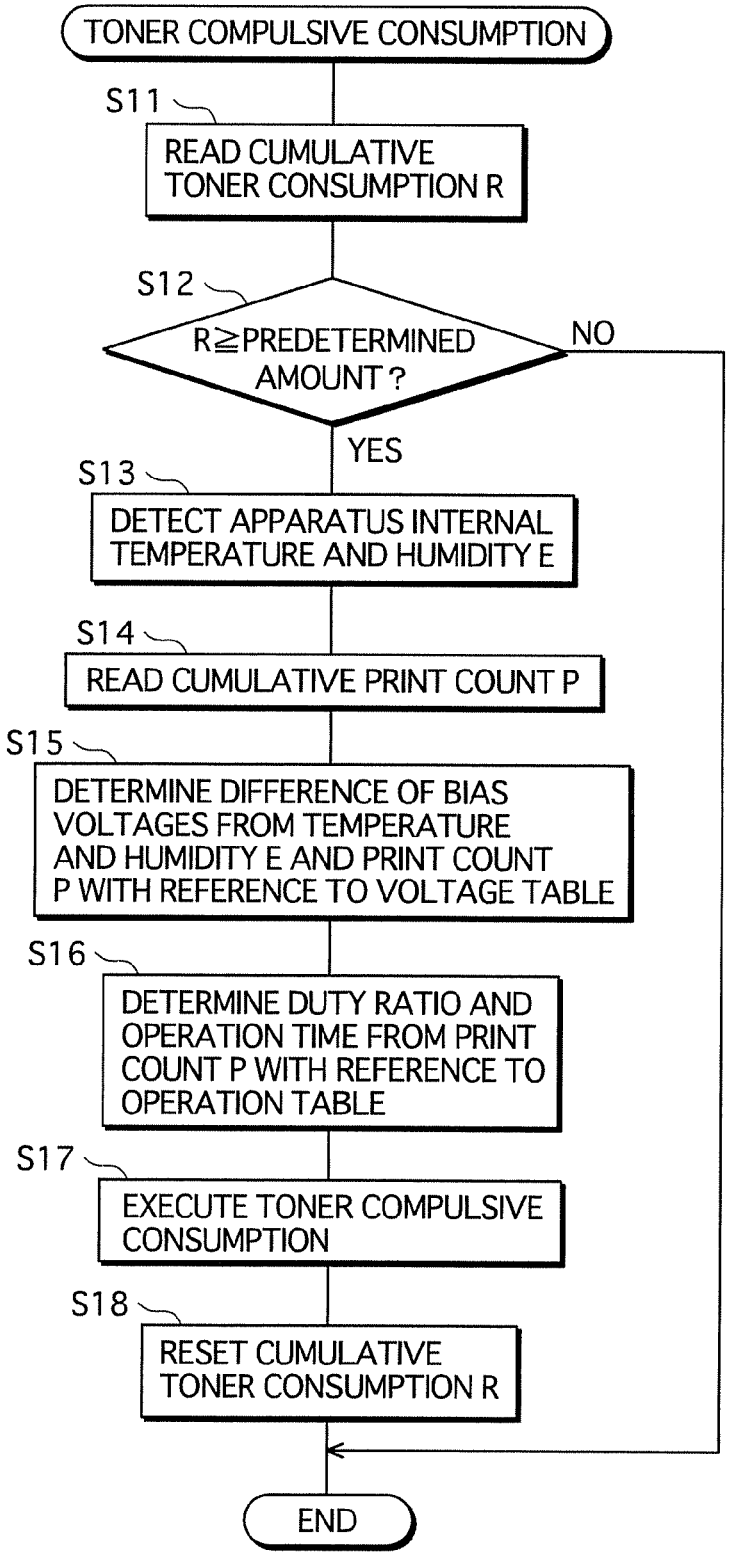
FIG. 11 is a flowchart showing an example of an operation process of the toner compulsive consumption mode.

FIG. 11 is a flowchart showing an example of an operation process in the toner compulsive consumption mode. This process is performed on each of the imaging units 2Y-2K in the same manner, for example, immediately after the completion of a print job.

As shown in the figure, data of cumulative toner consumption R stored in the cumulative toner consumption storage 206 is read (Step S11).

Next, it is judged whether the read cumulative toner consumption R is equal to or more than a predetermined amount R0 (Step S12). The predetermined amount R0 is a value used to judge whether execution of the toner compulsive consumption is necessary. According to the present embodiment, the toner compulsive consumption is executed when the cumulative toner consumption R becomes equal to or more than R0, judging that the amount of degraded toner has increased, due to friction between toner particles and deformation of toner particles in the developers 5Y-5K, to the level that has an influence on the image quality. The predetermined amount R0 is obtained in advance from an experiment or the like and the obtained data is stored in the ROM 203 or the like. Note that the predetermined amount R0 may be input, corrected or registered from an operation panel or the like at the discretion of the user.

In the case of R<R0 ("NO" in Step S12), the process is terminated straight away.

On the other hand, in the case of R≧R0 ("YES" in Step S12), apparatus internal temperature and humidity E are detected (Step S13). The detection is made based on a detection signal of the temperature and humidity sensor 16. Subsequently, a cumulative print count P stored in the cumulative print count storage 207 is read (Step S14).

With reference to the bias voltage information 2081 stored in the bias voltage table 208, the difference of the bias voltages corresponding to the apparatus internal temperature and humidity E is determined (Step S15). For example, when the apparatus internal temperature and humidity E is outside the condition of high-temperature and humidity, the bias voltage difference is set to 200 [V].

Next, with reference to the compulsive consumption operation information 2091 stored in the compulsive consumption operation table 209, the duty ratio of the bias voltages and the compulsive consumption operation time that correspond to the cumulative print count P are determined (Step S16). For example, when the cumulative print count P is 5000 [sheets], the duty ratio of the bias voltages and the compulsive consumption operation time are set to 0.3 and t1 [sec], respectively.

The toner compulsive consumption is executed based on the difference and duty ratio of the bias voltages and the compulsive consumption operation time determined in Steps S15 and S16 (Step S17). Specifically speaking, in response to an instruction, the power supply 15 outputs the bias voltage VB having the determined duty ratio, and the contacts of the switching unit 221 in the bias voltage switch unit 210 are switched to the state shown by the dotted lines in FIG. 10 and the contacts of the switching unit 222 are switched according to the determined difference of the bias voltages. For instance, when the difference of the bias voltages is determined as 200 [V], the contacts of the switching unit 221 are switched to the state shown by the solid lines.

In synchronization with the switching, while the photoreceptor drum 3, developer roller 52, supply roller 53 and the like of each of the imaging units 2Y-2K are rotationally driven, a latent image of the compulsive consumption image is formed on each photoreceptor drum 3 and then developed. When the determined compulsive consumption operation time elapses, the power supply 15 is instructed to stop outputting the bias voltage VB.

After the execution of the toner compulsive consumption, the cumulative toner consumption R actually stored in the cumulative toner consumption storage 206 is reset to zero (Step S18), and the process is then terminated.

As has been described, in the case of using toner with the normal charging polarity being negative, the degraded toner is readily collected to the developer roller 52 since the potential of the developing bias VB1 is set lower than that of the supply bias VB2 in the toner compulsive consumption mode. Accordingly, as compared to the conventional configuration in which degraded toner is collected to the doctor blade, it is possible that a larger amount of degraded toner is directly moved to the photoreceptor drum 3 by development, thereby realizing efficient consumption of the degraded toner.

In addition, it is designed that voltages applied to the developer roller 52 and the supply roller 53 are switched over between in the image formation mode and in the toner compulsive consumption mode. In the toner compulsive consumption mode, voltages having the same waveforms as those of the bias voltages used in the image formation mode can be used, which eliminates the need for providing a new power supply different from the power supply 15 for the execution of the toner compulsive consumption.

The above gives an example where the voltage difference, in the toner compulsive consumption, between the negative-side peak value V1*a* of the developing bias VB11 and the negative-side peak value V2*a* of the supply bias VB21 ranges from 100 to 200 [V]; it is however a matter of course that the present invention is not limited to this range of voltage difference.

An electric field ($1^{st}$ electric field) for attracting the reversely charged toner to the developer roller 52 may be generated between the developer roller 52 and the supply roller 53. The $1^{st}$ electric field can be generated by setting the bias voltages such that a value obtained by subtracting V2*a* from V1*a* becomes negative (the same polarity as the normal charging polarity of the toner).

The $1^{st}$ electric field may be intermittently generated, as in the above case, in a certain time period (a unit of time), or may be generated alternately with an electric field ($2^{nd}$ electric field) for attracting the reversely charged toner to the supply roller 53, as described later. In this case, in a unit of time, an integral value of force acting on the reversely charged toner (attraction to the developer roller 52) when the $1^{st}$ electric field is generated is made to be larger than an integral value of force acting on the reversely charged toner (attraction to the supply roller 53) when the $1^{st}$ electric field is switched to the $2^{nd}$ electric field, and thereby the degraded toner can be eventually collected to the developer roller 52.

Having the integral value of the force acting on the reversely charged toner is the same as taking the average of voltage. Here, the average is obtained by subtracting a negative-side area, with reference to 0 volt, enclosed by the voltage waveform per unit time from a positive-side area enclosed by the voltage waveform. For example, assume that the unit of time corresponds to one cycle. Here, in the case of the waveform W3, an average S1=0 is obtained by 480×0.7 (positive side)−1120×0.3 (negative side). Similarly, for the waveform W4, an average S2=60 is obtained.

The average of the voltage waveform W3 of the developing bias VB11 per unit time is denoted as S1 and the average of the voltage waveform W4 of the supply bias VB21 per unit time is denoted as S2. Here, by satisfying the relationship of S1−S2<0 (i.e. the value obtained by subtracting S2 from S1 indicates the same polarity as the normal charging polarity of the toner) when the normal charging polarity of the toner is negative, the same magnitude relationship as that of the integral values of the $1^{st}$ and $2^{nd}$ electric fields can be obtained, and consequently the degraded toner can be collected to the developer roller 52. The following, Embodiment 2 onwards, gives specific examples of waveforms that are different from the above-mentioned ones but yet satisfy the relationship of S1−S2<0.

Embodiment 2

The above embodiment gives an example where both developing bias voltage VB11 and supply bias voltage VB21 have rectangular waveforms. However, the present embodiment differs from the previous embodiment in that, in the toner compulsive consumption, one of the bias voltages is a direct-current voltage. In the following section, the same description as in Embodiment 1 is not repeated to avoid unnecessary duplication, and the same reference numerals are used for identical components.

Figure 12:
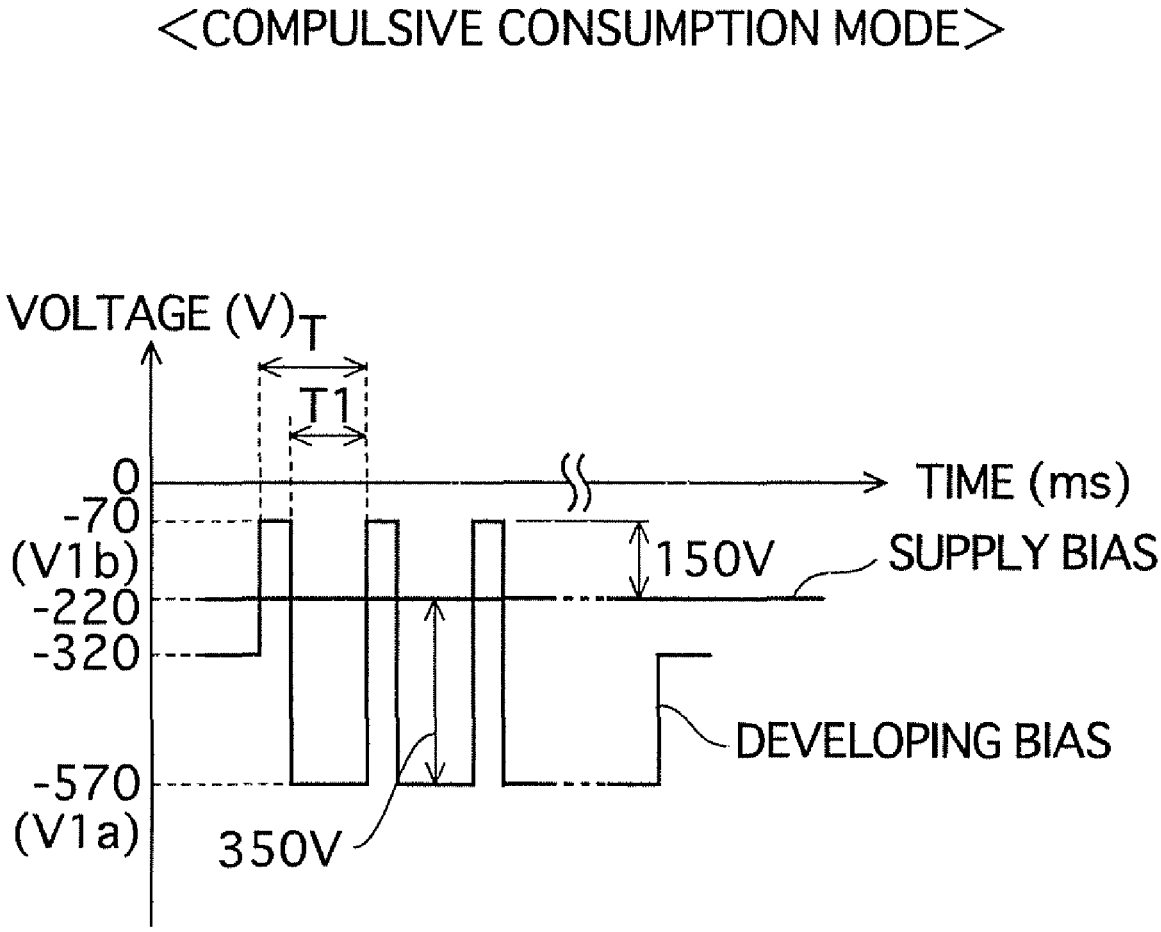
FIG. 12 shows an example of waveforms of bias voltages in a toner compulsive consumption mode according to Embodiment 2.

FIG. 12 shows an example of a bias voltage waveform in the toner compulsive consumption mode according to the present embodiment.

As shown in the figure, the developing bias voltage VB11 has a waveform (pulsating voltage) composed by superimposing, onto direct-current voltage whose DC component is −320 [V], a rectangular wave with a peak-to-peak value of 500 [V], a frequency of 2 [kHz] and a duty ratio (T1/T) of 0.7. On the other hand, the supply bias voltage VB21 is a constant direct-current voltage of −220 [V].

With such a waveform, the above-mentioned $1^{st}$ and $2^{nd}$ electric fields are alternately generated between the developer roller 52 and the supply roller 53, and forces in normal and reverse directions alternately act on the normally charged toner and reversely charged toner and the like in accordance with switching of the electric fields. As a result, sorting of the normally charged toner and degraded toner is further enhanced. Similarly to the above embodiment, in the present embodiment also, the difference and the duty ratio (corresponding to the magnitude of the difference between the averages S1 and S2 above) of the bias voltages are determined according to the apparatus internal temperature and humidity, the cumulative print count and the like. This is also true for the next embodiment.

Note that the requirement is to satisfy the relationship of S1−S2<0 and, for example, the developing bias voltage VB11 may have an alternate-current waveform.

Embodiment 3

Figures 13A, 13B, 13C:
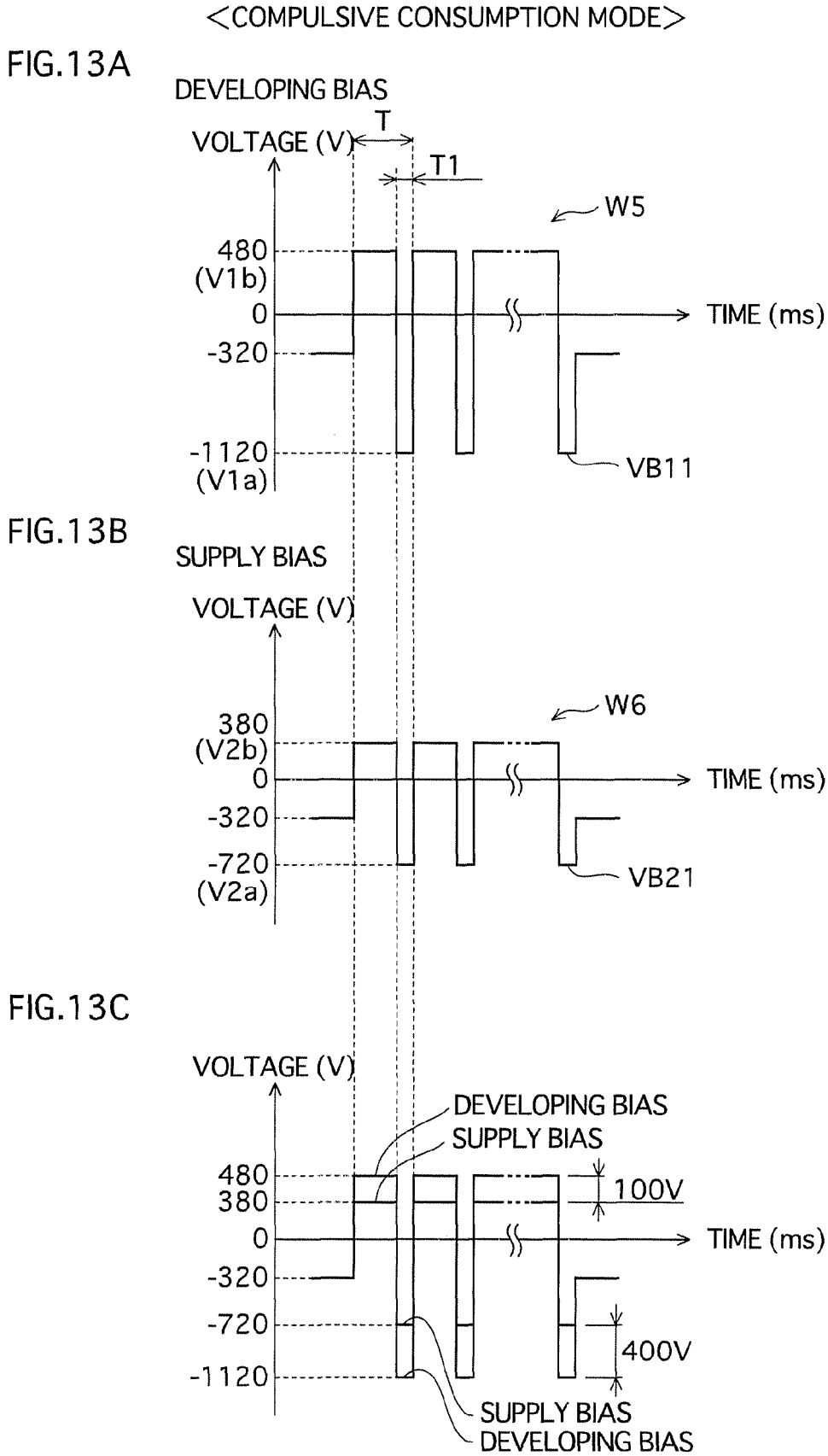
FIG. 13 shows an example of waveforms of bias voltages in a toner compulsive consumption mode according to Embodiment 3.

FIG. 13A shows a waveform W5 of the developing bias voltage VB11 in the toner compulsive consumption mode according to the present embodiment; FIG. 13B shows a waveform W6 of the supply bias voltage VB21 in the toner compulsive consumption mode; and FIG. 13C shows the waveforms W5 and W6 superimposed on top of each other.

As shown in FIG. 13A, the developing bias voltage VB11 has a waveform composed by superimposing, onto direct-current voltage whose DC component is −320 [V], a rectangular wave with a peak-to-peak value of 1600 [V], a frequency of 2 [kHz] and a duty ratio of 0.3 as an AC component.

As shown in FIG. 13B, the supply bias voltage VB21 has a waveform composed by superimposing, onto direct-current voltage whose DC component is −320 [V], a rectangular wave with a negative-side peak value of −720 [V], a positive-side peak value of +380 [V], a frequency of 2 [kHz], and a duty ratio of 0.3.

As shown in FIG. 13C, the phases of the waveforms W5 and W6 are synchronized. Here, the negative-side peak value of the supply bias voltage VB21 is 400 [V] higher than that of the developing bias voltage VB11, and the positive-side peak value of the developing bias voltage VB11 is 100 [V] higher than that of the supply bias voltage VB21. In one cycle, the difference in the bias voltages occurs at both positive and negative peaks, and therefore sorting of the normally charged toner and degraded toner is further enhanced.

The present invention is not limited to the development apparatus, and may be a development method. Furthermore, the present invention may be a program causing a computer to execute the method. The program of the present invention can be stored on various computer-readable recording media: magnetic disks such as a magnetic tape and a flexible disk; optical recording media such as a DVD-ROM, a DVD-RAM, a CD-ROM, a CD-R, an MO, and a PD; and flash-memory storage media. The present invention may be produced or transferred in the form of recording media, or may also be transmitted and supplied in the form of a program via networks as represented by the Internet, broadcasting, telecommunications and satellite communications.

Modifications

One aspect of the present invention has been explained based on each embodiment above. However, it is a matter of course that the present invention is not limited to the above embodiments and the following modifications are also within the scope of the present invention.

(1) In the above embodiment, temperature and humidity of the inside of the apparatus are detected; however, the present invention is not limited to this case, and temperature and humidity around the apparatus may be detected instead. In addition, instead of detecting both temperature and humidity, either one of them is used to perform the above-mentioned control. This is because the toner's charging characteristic and the like tend to be affected by changes in the environment including temperature and humidity.

Additionally, in the above embodiment, the temperature and humidity and the cumulative print count (corresponding to the cumulative operation time of the developer) are made variable conditions to change the difference and the duty ratio (i.e. to change the magnitude of the difference between the averages S1 and S2) of the bias voltages. However, the present invention is not limited to this case, and different variable conditions that have some influence on the movement of the toner due to electrostatic forces can be used instead. For example, ups and downs of barometric pressure can be considered as environmental variation and used as a variable condition. In addition, the print downtime (waiting time until the next printing (job)) may be used as a variable condition. This is because, in the case of the waiting time being long, the rise of charging of the toner becomes poor, as compared to the case of a short waiting time, which allows low charged toner and reversely charged toner more likely to be generated.

(2) Whether printing of original images whose print ratio (the ratio of the area printed to the area of the sheet of paper) is smaller than a predetermined value is continuously performed for a predetermined count of sheets can be also used as a variable condition. The reason for this is as follows: when the print ratio is smaller, a less amount of toner is consumed by development, and then if the toner left in the developers is kept being abraded by agitation and the like, the amount of toner whose charging characteristic becomes degraded is likely to increase. In the case of using the print ratio as a variable condition, for example, the continuous printing may be once stopped, and the printing may be started again after the execution of the toner compulsive consumption. Or the toner compulsive consumption may be automatically executed after the continuous printing ends. Additionally, the execution of continuous printing of images with small print ratios may be set as a condition for executing the toner compulsive consumption. Among the above variable conditions, only one—e.g. the temperature—may be used, or two or more in combination may be used.

(3) Regarding the bias voltages, the frequency, the duty ratio and the like in the above embodiments, appropriate values can be determined from experiments based on the charging characteristics of the toner and the photoreceptor drum, and the size, material and mass of the toner particles. Note that it is preferable that the difference of the bias voltages be set to 100 [V] or more. This is because the difference of the bias voltages is considered to have an influence on sorting of the normally charged toner and degraded toner. Also it is desirable to limit the voltage difference so as not to exceed 500 [V] in view of the leakage of electric charge. Regarding the frequency H, a too small frequency is undesirable since this tends to cause the toner particles to clamp together on one roller. On the other hand, if the frequency is too large, the toner particles are difficult to keep up with the action of positive/negative voltage switching. Accordingly, it is preferable to set it as $2 \leqq H \leqq 4$ [kHz], for example.

(4) Although in the above embodiments, rectangular waves are used, the present invention is not limited to this case and they may be sine waves or triangular waves, for example. In addition, the alternate current voltage is used as an example of voltage composed by superimposing a voltage component varying cyclically onto a direct-current voltage component; however, the requirement is to satisfy the relationship of $S1-S2<0$ and, for example, pulsating voltage may be used instead.

The above embodiments describe an example of the configuration in which the difference and duty ratio of the bias voltages are changed according to the apparatus internal temperature and humidity and the like; however, the present invention is not limited to this case. At least if the configuration satisfies the relationship of $S1-S2<0$, the consumption of the degraded toner can be improved.

(5) In the above embodiments, the normal charging polarity of the toner used is negative; however, the present invention is applicable to the case where it is positive. In the case where the normal charging polarity of the toner is positive, the relationship of positive and negative polarities in the above embodiments is inverted. Here, by arranging to satisfy the relationship of $S1-S2>0$, the degraded toner can be further efficiently consumed.

(6) The above embodiments describe an example in which the development apparatus and image forming apparatus of the present invention are applied to a tandem color digital printer; however, the present invention is not limited to this case. A development apparatus and an image forming apparatus including the development apparatus can be applied, regardless of color or monochrome image formation, to copiers, fax machines, MFPs (Multiple Function Peripherals), for example, if the development apparatus develops an electrostatic latent image formed on the image carrier of the photoreceptor drum or the like using toner.

Each of the above embodiments and modifications describes a single control; however, the present invention is not limited to this case. It is a matter of course that the present invention includes a structure in which two or more of the above embodiments and modifications are combined.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be constructed as being included therein.

What is claimed is:

1. A development apparatus that develops an electrostatic latent image formed on an image carrier, comprising:

a developer roller operable to carry toner on a circumferential surface thereof and develop the electrostatic latent image using the toner;

a supply roller operable to perform toner supply to the developer roller;

a voltage applier operable to apply a bias voltage V1 to the developer roller and apply a bias voltage V2 to the supply roller; and a controller configured to control the voltage applier in an image formation mode so that a value obtained by subtracting an average S2 of the bias voltage V2 per unit time from an average S1 of the bias voltage V1 per unit time indicates a different polarity than a charging polarity of the toner when the toner is in a non-degraded state, and to control the voltage applier in a toner consumption mode so that a value obtained by subtracting the average S2 of the bias voltage V2 per unit time from the average S1 of the bias voltage V1 per unit time indicates a same polarity as the charging polarity of the toner when the toner is in the non-degraded state, the toner consumption mode performing development at a time of non-image formation being a time other than image formation based on a print job externally sent thereto to discharge the degraded toner accumulated in the development apparatus to the outside thereof.

2. The development apparatus of claim 1, wherein each of the bias voltages V1 and V2 is a voltage composed by superimposing a voltage component varying cyclically onto a direct-current voltage component, and the bias voltages V1 and V2 have a same frequency with synchronized phases, and the controller controls the voltage applier in the toner consumption mode so that (i) a value obtained by subtracting V2*a* from V1*a* indicates the same polarity as the charging polarity of the toner when the toner is in the non-degraded state and (ii) a relational expression of V1*b*=V2*b* is satisfied, where V1*a* is peak potential of the bias voltage V1 in the charging polarity of the toner when the toner is in the non-degraded state within a cycle, V2*a* is peak potential of the bias voltage V2 in the charging polarity of the toner when the toner is in the non-degraded state within a cycle, V1*b* is peak potential of the bias voltage V1 in a polarity opposite to the charging polarity of the toner when the toner is in the non-degraded state within a cycle, and V2*b* is peak potential of the bias voltage V2 in the opposite polarity within a cycle.

3. The development apparatus of claim 2, wherein the bias voltages V1 and V2 are alternating-current voltages.

4. The development apparatus of claim 1, wherein each of the bias voltages V1 and V2 is a voltage composed by superimposing a voltage component varying cyclically onto a direct-current voltage component, and the bias voltages V1 and V2 have a same frequency with synchronized phases, and the controller controls the voltage applier in the toner consumption mode so that both a value obtained by subtracting V2*a* from V1 *a* and a value obtained by subtracting V1 *b* from V2*b* indicate the same polarity as the charging polarity of the toner when the toner is in the non-degraded state, where V1*a* is peak potential of the bias voltage V1 in the charging polarity of the toner when the toner is in the non-degraded state within a cycle, V2*a* is peak potential of the bias voltage V2 in the charging polarity of the toner when the toner is in the non-degraded state within a cycle, V1*b* is peak potential of the bias voltage V1 in a polarity opposite to the charging polarity of the toner when the toner is in the non-degraded state within a cycle, and V2*b* is peak potential of the bias voltage V2 in the opposite polarity within a cycle.

5. The development apparatus of claim 4, wherein the bias voltages V1 and V2 are alternating-current voltages.

6. The development apparatus of claim 1, wherein the bias voltage V1 is a voltage composed by superimposing a voltage component varying cyclically onto a direct-current voltage component having the same polarity as the charging polarity of the toner when the toner is in the non-degraded state, the bias voltage V2 is a constant direct-current voltage having the same polarity as the charging polarity of the toner when the toner is in the non-degraded state, and the controller controls the voltage applier in the toner consumption mode so that potential of the bias voltage V2 falls in range of V1*a* to V1*b*, where V1*a* is peak potential of the bias voltage V1 in the charging polarity of the toner when the toner is in the non-degraded state within a cycle and V1*b* is peak potential of the bias voltage V1 in a polarity opposite to the charging polarity of the toner when the toner is in the non-degraded state within a cycle.

7. The development apparatus of claim 6, wherein the bias voltage V1 is either one of a pulsating voltage and an alternating-current voltage.

8. The development apparatus of claim 1, wherein the controller changes, in the toner consumption mode, magnitude of a difference between the averages S1 and S2 based on a predetermined condition.

9. The development apparatus of claim 8, wherein the predetermined condition is whether temperature inside or around the development apparatus is (i) less than or equals to a $1^{st}$ predetermined value or (ii) more than the $1^{st}$ predetermined value and/or whether humidity inside or around the development apparatus is (i) less than or equals to a $2^{nd}$ predetermined value or (ii) more than the $2^{nd}$ predetermined value, and the controller sets the magnitude of the difference to a $1^{st}$ magnitude when the temperature is less than or equals to the $1^{st}$ predetermined value and/or the humidity is less than or equals to the $2^{nd}$ value, and sets the magnitude of the difference to a $2^{nd}$ magnitude being smaller than the $1^{st}$ magnitude when the temperature is more than the $1^{st}$ predetermined value and/or the humidity is more than the $2^{nd}$ predetermined value.

10. The development apparatus of claim 8, wherein the predetermined condition is whether a cumulative operation time of the development apparatus at present (i) is within a predetermined period of time or (ii) exceeds the predetermined period of time, and the controller sets the magnitude of the difference to a $1^{st}$ magnitude when the cumulative operation time is within the predetermined period of time, and sets the magnitude of the difference to a $2^{nd}$ magnitude being larger than the $1^{st}$ magnitude when the cumulative operation time exceeds the predetermined period of time.

11. The development apparatus of claim 8, wherein the controller changes the difference by altering a duty ratio in a cycle when one or both of the bias voltages V1 and V2 is a voltage composed by superimposing a voltage component varying cyclically onto a direct-current voltage component.

12. An image forming apparatus including a developer operable to develop an electrostatic latent image formed on an image carrier with use of toner, wherein the developer is the development apparatus of claim 1.

13. A development method used on a development apparatus including a developer roller for developing an electrostatic latent image formed on an image carrier with use of toner carried on a circumferential surface of the developer roller and a supply roller for performing toner supply to the developer roller, in order to consume a degraded toner accumulated in the development apparatus, the development method including:

estimating a state of degradation of the toner;

when it is determined that the state of degradation of the toner is below a predetermined level, controlling a voltage applier that applies a bias voltage V1 to the developer roller and applies a bias voltage V2 to the supply roller in a first mode so that a value obtained by subtracting an average S2 of the bias voltage V2 per unit time from an average S1 of the bias voltage V1 per unit time indicates a different polarity than a charging polarity of the toner when the toner is in a non-degraded state; and when it is determined that the state of degradation of the toner is above the predetermined level, controlling the voltage applier that applies the bias voltage V1 to the developer roller and applies the bias voltage V2 to the supply roller in a second mode so that the value obtained by subtracting the average S2 of the bias voltage V2 per unit time from the average S1 of the bias voltage V1 per unit time indicates a same polarity as the charging polarity of the toner when the toner is in the non-degraded state.

14. The development method of claim 13, wherein each of the bias voltages V1 and V2 is a voltage composed by superimposing a voltage component varying cyclically onto a direct-current voltage component, and the bias voltages V1 and V2 have a same frequency with synchronized phases, and the control step controls the voltage applier in the second mode so that (i) a value obtained by subtracting V2*a* from V1*a* indicates the same polarity as the charging polarity of the toner when the toner is in the non-degraded state and (ii) a relational expression of V1*b*=V2*b* is satisfied, where V1*a* is peak potential of the bias voltage V1 in the charging polarity of the toner when the toner is in the non-degraded state within a cycle, V2*a* is peak potential of the bias voltage V2 in the charging polarity of the toner when the toner is in the non-degraded state within a cycle, V1*b* is peak potential of the bias voltage V1 in a polarity opposite to the charging polarity of the toner when the toner is in the non-degraded state within a cycle, and V2*b* is peak potential of the bias voltage V2 in the opposite polarity within a cycle.

15. The development method of claim 13, wherein each of the bias voltages V1 and V2 is a voltage composed by superimposing a voltage component varying cyclically onto a direct-current voltage component, and the bias voltages V1 and V2 have a same frequency with synchronized phases, and the control step controls the voltage applier in the second mode so that both a value obtained by subtracting V2*a* from V1*a* and a value obtained by subtracting V1*b* from V2*b* indicate the same polarity as the charging polarity of the toner when the toner is in the non-degraded state, where V1*a* is peak potential of the bias voltage V1 in the charging polarity of the toner when the toner is in the non-degraded state within a cycle, V2*a* is peak potential of the bias voltage V2 in the charging polarity of the toner when the toner is in the non-degraded state within a cycle, V1*b* is peak potential of the bias voltage V1 in a polarity opposite to the charging polarity of the toner when the toner is in the non-degraded state within a cycle, and V2*b* is peak potential of the bias voltage V2 in the opposite polarity within a cycle.

16. The development method of claim 13, wherein the bias voltage V1 is a voltage composed by superimposing a voltage component varying cyclically onto a direct-current voltage component having the same polarity as the charging polarity of the toner when the toner is in the non-degraded state, the bias voltage V2 is a constant direct-current voltage having the same polarity as the charging polarity of the toner when the toner is in the non-degraded state, and the control step controls the voltage applier in the second mode so that potential of the bias voltage V2 falls in range of V1*a* to V1*b*, where V1*a* is peak potential of the bias voltage V1 in the charging polarity of the toner when the toner is in the non-degraded state within a cycle and V1*b* is peak potential of the bias voltage V1 in a polarity opposite to the charging polarity of the toner when the toner is in the non-degraded state within a cycle.

17. The development method of claim 13, wherein the control step changes, in second mode, magnitude of a difference between the averages S1 and S2 based on a predetermined condition.

18. The development method of claim 17, wherein the predetermined condition is whether temperature inside or around the development apparatus is (i) less than or equals to a $1^{st}$ predetermined value or (ii) more than the $1^{st}$ predetermined value and/or whether humidity inside or around the development apparatus is (i) less than or equals to a $2^{nd}$ predetermined value or (ii) more than the $2^{nd}$ predetermined value, and the control step sets the magnitude of the difference to a $1^{st}$ magnitude when the temperature is less than or equals to the $1^{st}$ predetermined value and/or the humidity is less than or equals to the $2^{nd}$ value, and sets the magnitude of the difference to a $2^{nd}$ magnitude being smaller than the $1^{st}$ magnitude when the temperature is more than the $1^{st}$ predetermined value and/or the humidity is more than the $2^{nd}$ predetermined value.

19. The development method of claim 17, wherein the predetermined condition is whether a cumulative operation time of the development apparatus at present (i) is within a predetermined period of time or (ii) exceeds the predetermined period of time, and the control step sets the magnitude of the difference to a $1^{st}$ magnitude when the cumulative operation time is within the predetermined period of time, and sets the magnitude of the difference to a $2^{nd}$ magnitude being larger than the $1^{st}$ magnitude when the cumulative operation time exceeds the predetermined period of time.

20. The development method of claim 17, wherein the control step changes the difference by altering a duty ratio in a cycle when one or both of the bias voltages V1 and V2 is a voltage composed by superimposing a voltage component varying cyclically onto a direct-current voltage component.

* * * * *